US008437658B2

(12) United States Patent
Honobe et al.

(10) Patent No.: US 8,437,658 B2
(45) Date of Patent: May 7, 2013

(54) IMAGE FORMING APPARATUS

(75) Inventors: Satoshi Honobe, Kanagawa (JP); Hiroki Ando, Kanagawa (JP); Toshiyuki Matsui, Kanagawa (JP); Tomonori Sato, Kanagawa (JP); Tsuneo Fukuzawa, Kanagawa (JP); Fumiaki Maekawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 231 days.

(21) Appl. No.: 12/805,672

(22) Filed: Aug. 12, 2010

(65) Prior Publication Data

US 2011/0116831 A1 May 19, 2011

(30) Foreign Application Priority Data

Nov. 17, 2009 (JP) ..... 2009-262252

(51) Int. Cl.
*G03G 15/00* (2006.01)

(52) U.S. Cl.
USPC ..... 399/110; 399/167; 399/162

(58) Field of Classification Search ..... 399/167, 399/110, 162, 165
See application file for complete search history.

(56) References Cited

U.S. PATENT DOCUMENTS 6,233,415 B1 * 5/2001 Pang ..... 399/116
6,973,278 B2 * 12/2005 Miller et al. ..... 399/116

FOREIGN PATENT DOCUMENTS

JP 2009-122391 A 6/2009

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus includes an operating portion that moves between a first operating position in which each of positioning members is moved to each of positioning positions and a second operating position in which each of the positioning members is moved to each of releasing positions through each of transmitting members and each of transmitted members when a first transmitting member and a first transmitted member are coupled to each other, and that carries out the movement to a first operating position to move a second positioning member to a second positioning position through a second transmitting member and a second transmitted member and carries out the movement to a second operating position to move the second positioning member to a second releasing position when the first transmitting member and the first transmitted member are decoupled from each other.

13 Claims, 20 Drawing Sheets

Rd
67
68
64y
63y
62y
66y
BM1
T1y
PRy
64m
63m
62m
66m
56
BM2
LN
60
58
T1m
PRm
64c
63c
62c
66c
T1c
PRc
29
B
59
57
64k
63k
62k
66k
T1k
PRk
Rw
69a'
61'
69'
Rf
T2a
Rt
44
41 (71)
α
Z
X
Y
(-X)
(-Y)
(-Z)

IMAGE FORMING APPARATUS

CROSS-REFERENCE TO RELATED APPLICATION

This application is based on and claims priority under 35 USC 119 from Japanese Patent Application No. 2009-262252 filed on Nov. 17, 2009.

BACKGROUND

1. Technical Field

The present invention relates to an image forming apparatus.

2. Related Art

In an image forming apparatus such as a copying machine or a printer which is of an electrophotographic type, with a structure in which an image holding member, a developing device and an intermediate transfer member may be exchanged, the intermediate transfer member and a photosensitive member are caused to approach or separate from each other or the photosensitive member and the other respective members are positioned in a process for an exchanging work in some cases.

SUMMARY

According to an aspect of the invention, an image forming apparatus includes:

a first positioned member;

a first positioning member that moves between a first positioning position in which the first positioned member is positioned and a first releasing position in which the positioning of the first positioned member is released;

a first transmitted member supported on the first positioning member;

a second positioned member;

a second positioning member that moves between a second positioning position in which the second positioned member is positioned and a second releasing position in which the positioning of the second positioned member is released;

a second transmitted member supported on the second positioning member;

an operating portion that is operated by an operator;

a first transmitting member supported on the operating portion, coupled removably to the first transmitted member and transmitting an operation of the operating portion to the first transmitted member;

a second transmitting member supported on the operating portion and transmitting the operation of the operating portion to the second transmitted member; and the operating portion that moves between a first operating position in which each of the positioning members is moved to each of the positioning positions and a second operating position in which each of the positioning members is moved to each of the releasing positions through each of the transmitting members and each of the transmitted members when the first transmitting member and the first transmitted member are coupled to each other, and that carries out the movement to the first operating position to move the second positioning member to the second positioning position through the second transmitting member and the second transmitted member and carries out the movement to the second operating position to move the second positioning member to the second releasing position when the first transmitting member and the first transmitted member are decoupled from each other.

BRIEF DESCRIPTION OF THE DRAWINGS

Exemplary embodiments of the invention will be described in detail based on the following figures, wherein.

DETAILED DESCRIPTION

Figure 1:
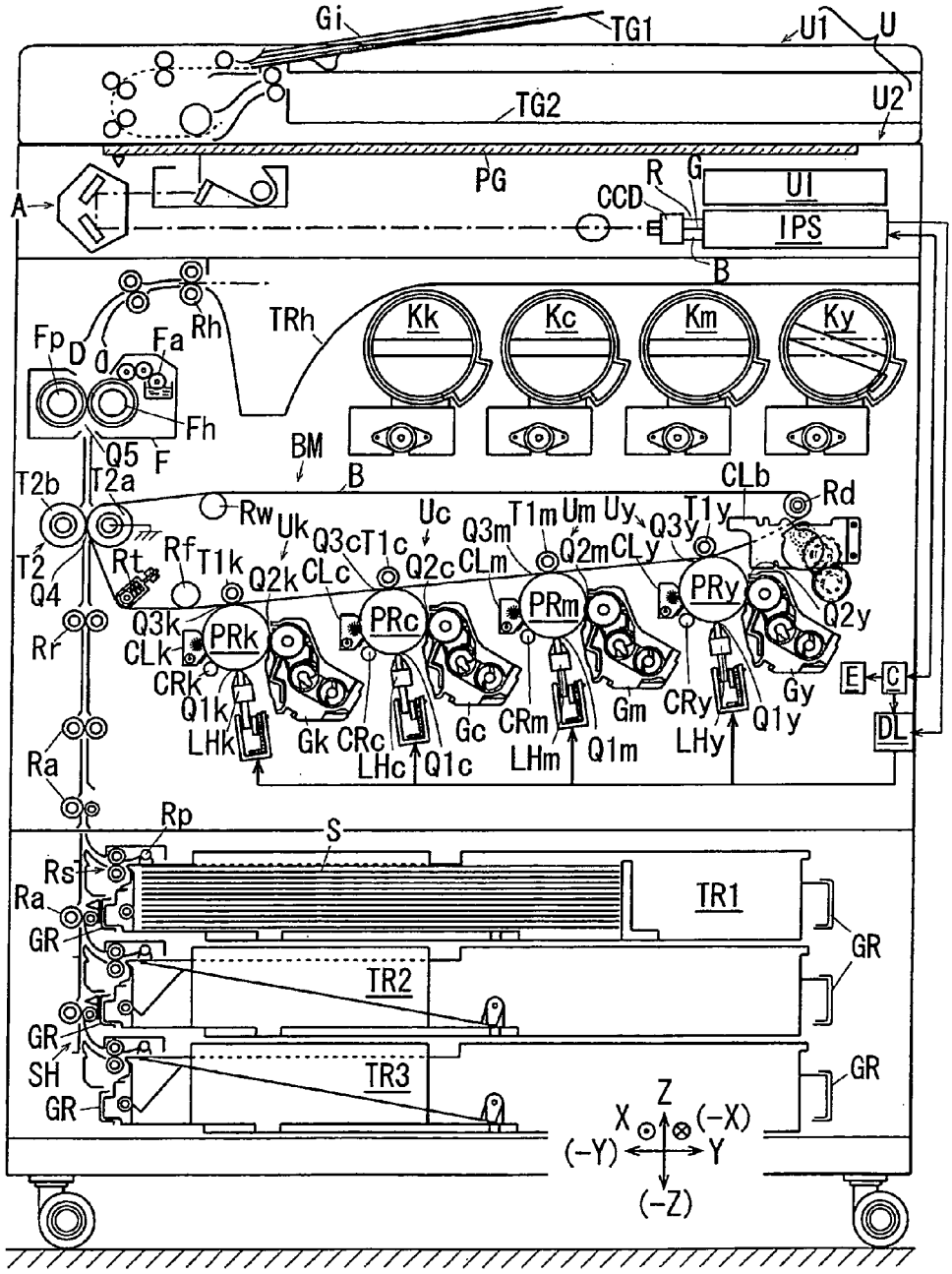
FIG. 1 is an explanatory view showing a whole image forming apparatus according to a first example.

Next, examples to be specific examples according to an exemplary embodiment of the invention will be described with reference to the drawings, and the invention is not restricted to the following examples.

For easy understanding of the following description, in the drawings, a longitudinal direction is set to be an X-axis direction, a transverse direction is set to be a Y-axis direction, a vertical direction is set to be a Z-axis direction, and directions or sides indicated as arrows X, −X, Y, −Y, Z and −Z are set to be forward, rearward, rightward, leftward, upward and downward directions or front, rear, right, left, upper and lower sides, respectively.

In the drawings, moreover, it is assumed that a circle having "•" described therein implies an arrow turned from a back side of a paper toward a right side thereof, and a circle having "X" described therein implies an arrow turned from the right side of the paper to the back side thereof.

In the following description using the drawings, an illustration of members other than necessary members for explanation will be properly omitted for easy understanding.

FIRST EXAMPLE

FIG. 1 is an explanatory view showing a whole image forming apparatus according to a first example.

In FIG. 1, a copying machine U according to an example of the image forming apparatus in accordance with the first example includes an automatic document feeder device U1 and a device body U2 supporting the automatic document feeder device U1 and having a transparent document reading surface PG on an upper end.

The automatic document feeder device U1 has a document feeding portion TG1 in which plural of documents Gi to be copied is stacked and accommodated, and a document discharging portion TG2 for discharging the document Gi fed from the document feeding portion TG1 and passing through a document reading position on the document reading surface PG.

The device body U2 has a user interface UI according to an example of an input operating portion for inputting a working command signal for starting an image forming operation by a user, and an exposing optical system A.

A light reflected by the document delivered over the document reading surface PG by the automatic document feeder device U1 or a document put on the document reading surface PG manually is converted into electric signals of red: R, green: G and blue: B by a solid state imaging device CCD through the exposing optical system A.

An information converting portion IPS converts the electric signals of the R, G, and B input from the solid state imaging device CCD into image information about black: K, yellow: Y, magenta: M, and cyan: C and temporarily stores them, and outputs the image information as image information for forming a latent image at a preset time to a latent image forming circuit DL.

In the case in which a document image is a monochromatic image, the image information about only the black: K is input to the latent image forming circuit DL.

The latent image forming circuit DL has driving circuits for the respective colors of Y, M, C and K which are not shown, and outputs signals corresponding to the input image information to latent image forming devices LHy, LHm, LHc and LHk disposed for the respective colors at a preset time.

Figure 2:
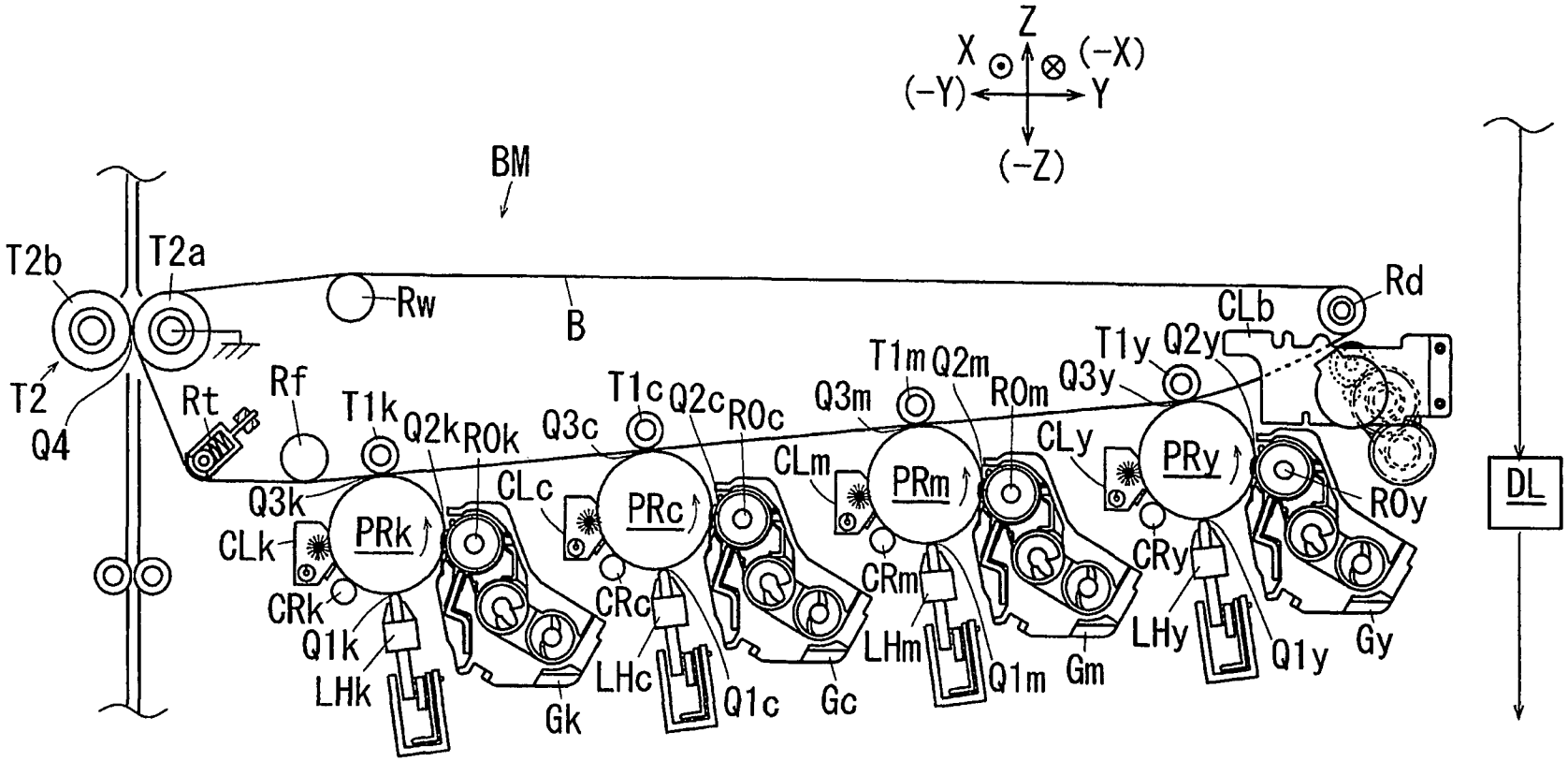
FIG. 2 is an enlarged explanatory view showing a main part of the image forming apparatus according to the first example.

FIG. 2 is an enlarged explanatory view showing a main part of the image forming apparatus according to the first example.

Visible image forming devices Uy, Urn, Uc and Uk disposed in a central part in a direction of a gravity of the copying machine U serve to form visible images for the colors of Y, M, C and K, respectively.

Latent image writing lights for Y, M, C and K emitted from light sources of the latent image forming devices LHy, LHm, LHc and LIR are incident on photosensitive members PRy, PRm, PRc and PRk according to an example of a second positioned member and an example of an image holding member, respectively. In the first example, the latent image forming devices LHy to LHk are constituted by devices in which LEDs: Light Emission Diodes to be writing elements are arranged and disposed in a straight line, that is, an LED array.

The visible image forming device Uy for the Y color has the photosensitive member PRy to be rotated, a charger CRy, the latent image forming device LHy, a developing device Gy, a primary transfer unit T1*y*, and a photosensitive member cleaner CLy according to an example of an image holding member cleaning unit. In the first example, the photosensitive member PRy, the charger CRy and the photosensitive member cleaner CLy are constituted as a removable image holding member unit integrally with the device body U2.

All of the visible image forming devices Um, Uc and Uk are constituted in the same manner as the visible image forming device Uy for the Y color.

In FIGS. 1 and 2, the photosensitive members PRy, PRm, PRc and PRk are charged by the respective chargers CRy, CRm, CRc and CRk and electrostatic latent images are then formed on surfaces thereof by the latent image writing light in image writing positions Q1*y*, Q1*m*, Q1*c* and Q1*k*. The electrostatic latent images formed on the surfaces of the photosensitive members PRy, PRm, PRc and PRk are developed into toner images according to an example of visible images with developers held in developing rolls R0*y*, R0*m*, R0*c* and R0*k* according to an example of developer holding members of developing devices Gy, Gm, Gc and Gk in developing regions Q2*y*, Q2*m*, Q2*c* and Q2*k*.

The toner images thus developed are transported to primary transfer regions Q3*y*, Q3*m*, Q3*c* and Q3*k* to come in contact with an intermediate transfer belt B according to an example of a first positioned member and an example of an intermediate transfer member. A primary transfer voltage having a reverse polarity to a charging polarity of a toner is applied, at a preset time, from a power circuit E to be controlled by a controller C according to an example of a controlling portion to primary transfer units T1*y*, T1*m*, T1*c* and T1*k* disposed on a back side of the intermediate transfer belt B in the primary transfer regions Q3*y*, Q3*m*, Q3*c* and Q3*k*.

The toner images on the photosensitive members PRy to PRk are primarily transferred onto the intermediate transfer belt B according to an example of the intermediate transfer member through the primary transfer units T1*y*, T1*m*, T1*c* and T1*k*. A residual substance or deposit on the surfaces of the photosensitive members PRy, PRm, PRc and PRk subjected to the primary transfer is cleaned away by photosensitive member cleaners CLy, CLm, CLc and CLk. The surfaces of the photosensitive members PRy to PRk thus cleaned are recharged by the chargers CRy to CRk.

A belt module BM according to an example of an intermediate transfer device is disposed above the photosensitive members PRy to PRk. The belt module BM has the intermediate transfer belt B, a belt driving roll Rd according to an example of an intermediate transfer member driving member, a tension roll Rt according to an example of a tension applying member, a walking roll Rw according to an example of a meander preventing member, an idler roll Rf according to an example of a driven member, a backup roll T2*a* according to an example of a secondary transfer opposing member, and the primary transfer units T1*y* to T1*k*. The intermediate transfer belt B is supported rotatably and movably by the rolls Rd, Rt, Rw, Rf and T2*a*.

Moreover, the rotation detecting member SN1 is disposed in the belt module BM. The rotation detecting member SN1 serves to detect a rotation of the intermediate transfer belt B. The rotation detecting member SN1 according to the first example detects a detected portion (not shown) disposed on one of ends of the intermediate transfer belt B within a preset rotating time, thereby detecting the rotation of the intermediate transfer belt B. In the first example, a time required for the intermediate transfer belt B to take a rotation is set to be the rotating time.

Moreover, a secondary transfer roll T2*b* according to an example of a secondary transfer member is disposed opposite to a surface of the intermediate transfer belt B provided in contact with the backup roll T2*a*. A secondary transfer unit T2 is constituted by the backup roll T2*a* and the secondary transfer roll T2*b*. Furthermore, a secondary transfer region Q4 is formed by the secondary transfer roll T2*b* and an opposed region of the intermediate transfer belt B.

Monochromatic or multicolored toner images superimposed and transferred sequentially onto the intermediate transfer belt B by the primary transfer units T1*y* to T1*k* in the primary transfer regions Q3*y* to Q3*k* are transported to the secondary transfer region Q4.

A transfer device (T1+T2+B) according to the first example is constituted by the primary transfer units T1*y* to T1*k*, the intermediate transfer belt B and the secondary transfer unit T2. The transfer device (T1+T2+B) serves to transfer, onto a medium, the images formed on the photosensitive members PRy to PRk.

A pair of left and right guide rails GR according to an example of a guiding member is provided in three stages below the visible image forming devices Uy to Uk, and paper supplying trays TR1 to TR3 according to an example of a paper supplying portion are supported to be put in/out in a longitudinal direction by the guide rails GR. Recording sheets S according to an example of a medium accommodated in the paper supplying trays TR1 to TR3 are taken out by a pickup roll Rp according to an example of a medium take-out member and are separated one by one through a separating roll Rs according to an example of a medium separating member. Then, the recording sheet S is transported through plural of feed rolls Ra according to an example of a medium transporting member along a sheet transporting path SH according to an example of a medium transporting path, and is fed to a registration roll Rr according to an example of a time regulating member which is disposed on an upstream side in a sheet transporting direction of the secondary transfer region Q4. A sheet feeding device (SH+Ra+Rr) is constituted by the sheet transporting path SH, the sheet transporting roll Ra and the registration roll Rr.

The registration roll Rr transports the recording sheet S to the secondary transfer region Q4 in adaptation to a time that the toner image formed on the intermediate transfer belt B is conveyed to the secondary transfer region Q4. When the recording sheet S passes through the secondary transfer region Q4, the backup roll T2*a* is grounded and a secondary transfer voltage having a reverse polarity to a charging polarity of a toner is applied to the secondary transfer unit T2*b* from the power circuit E to be controlled by the controller C. At this time, the toner image on the intermediate transfer belt B is transferred onto the recording sheet S by the secondary transfer unit T2.

The intermediate transfer belt B subjected to the secondary transfer is cleaned by a belt cleaner CLb according to an example of an intermediate transfer member cleaning unit.

The recording sheet S having the toner image transferred secondarily is transported to a fixing region Q5 to be a contact region of a heating roll Fh according to an example of a fixing member for heating in a fixing device F and a pressure roll Fp according to an example of a fixing member for pressurization, and is heated and fixed when passing through the fixing region. The recording sheet S heated and fixed is discharged from a discharging roller Rh according to an example of a medium discharging member to a paper discharging tray TRh according to an example of a medium discharging portion.

A surface of the heating roll Fh is coated with a mold releasing agent by a mold releasing agent coating device Fa. The mold releasing agent serves to enhance a mold releasing property of the recording sheet S from the heating roll.

Developer cartridges Ky, Km, Kc and Kk according to an example of a developer housing container for accommodating respective developers of yellow Y, magenta M, cyan C and black K are disposed above the belt module BM. The developers accommodated in the developer cartridges Ky to Kk are supplied to the developing devices Gy to Gk depending on a consumption of the developers in the developing devices Gy to Gk. In the first example, the developer to be accommodated in each of the developing devices Gy to Gk is constituted by a two-component developer containing a magnetic carrier and a toner to which an outer additive is applied, and a so-called high concentration toner having a higher ratio of a toner to a carrier than that in the developer in each of the developing devices Gy to Gk is supplied from each of the developer cartridges Ky to Kk.

(Explanation of Opening/Closing Plate 6 According to First Example)

Figure 3:
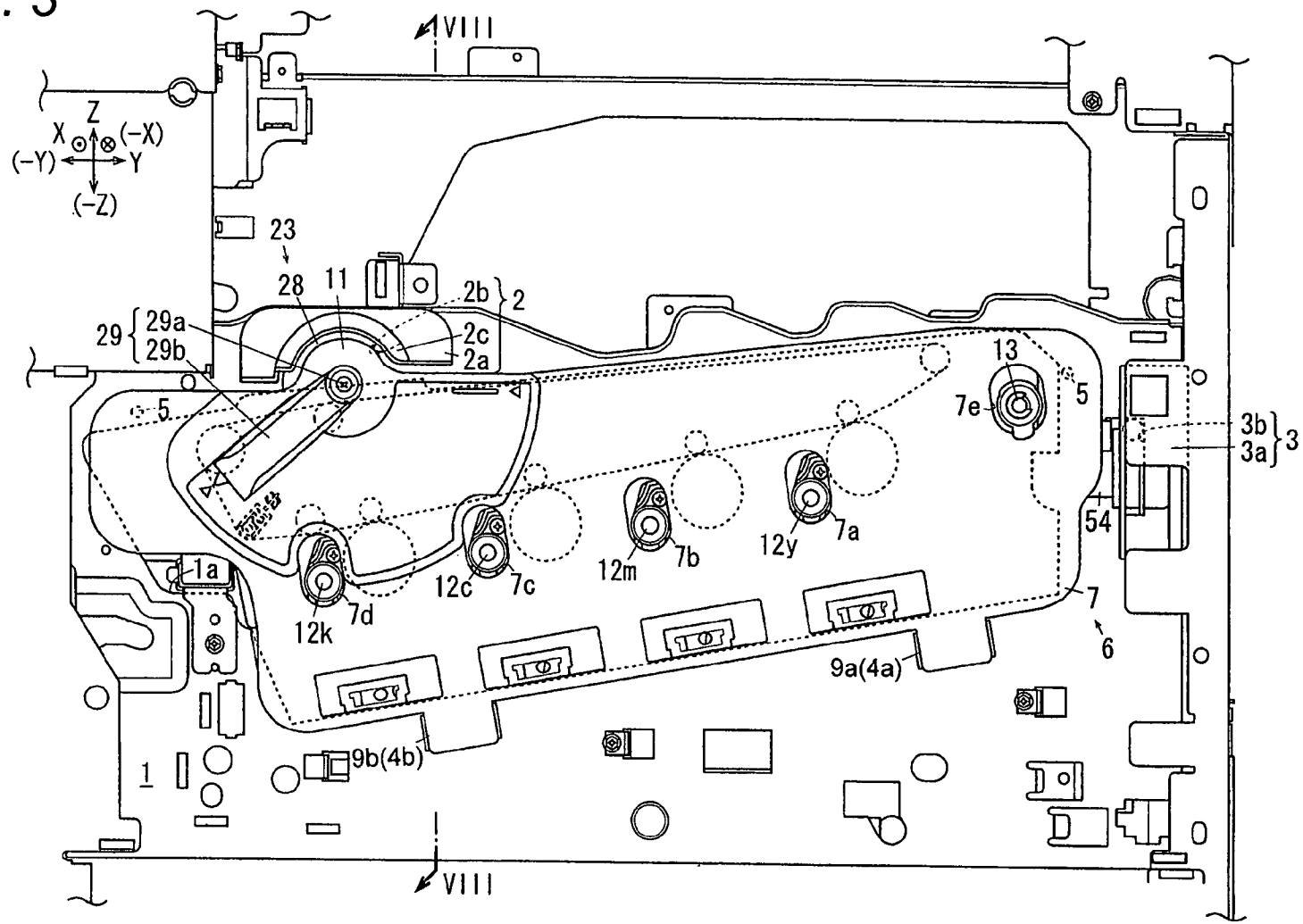
FIG. 3 is an explanatory view showing an opening/closing plate according to the first example, illustrating a front wall member of the opening/closing plate in an attaching state to a frame member.

FIG. 3 is an explanatory view showing an opening/closing plate according to the first example, illustrating a front wall member of the opening/closing plate in an attaching state to a frame member.

Figure 4:
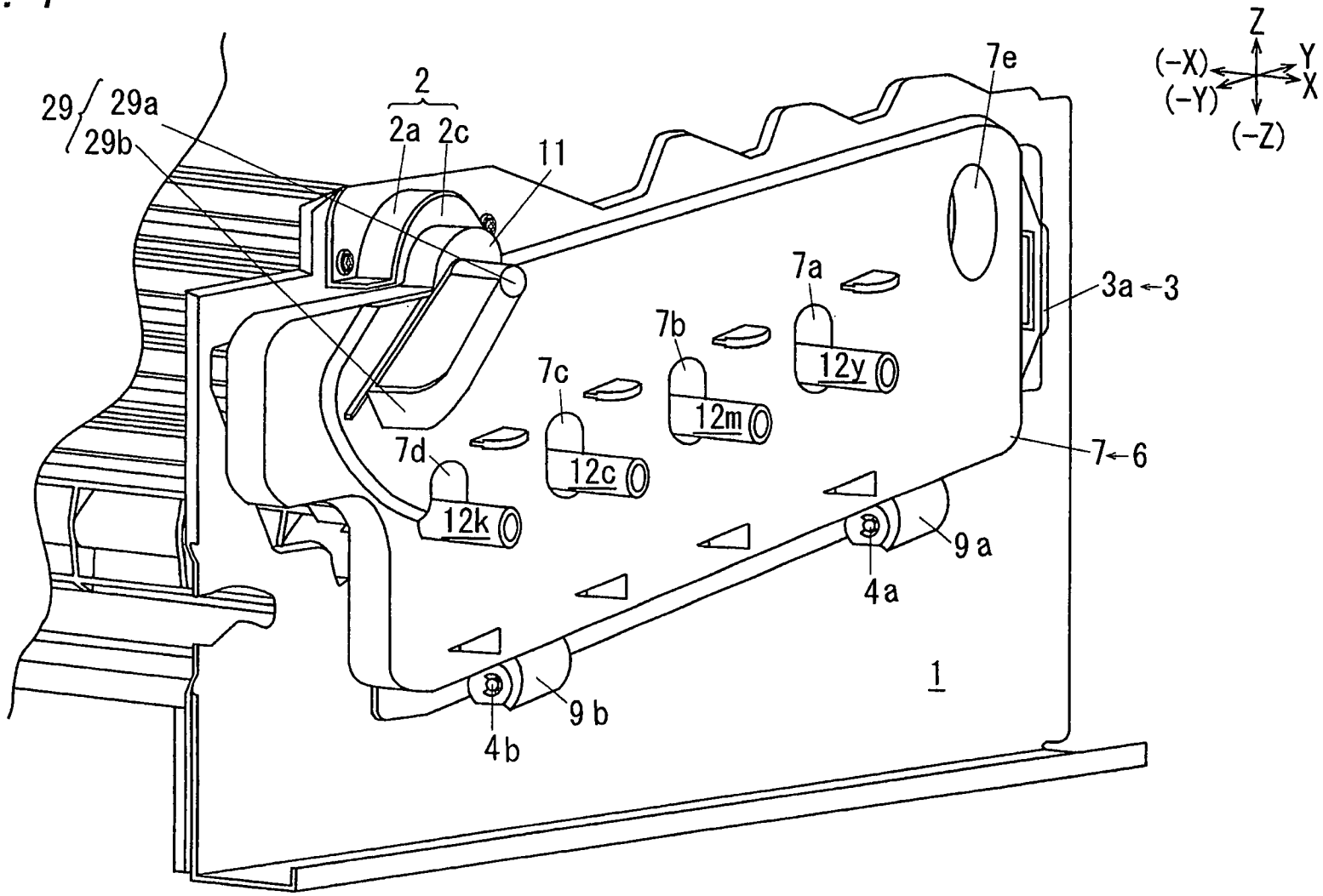
FIG. 4 is an explanatory view showing a state in which the opening/closing plate is seen rightward, obliquely and downward from a left, oblique and upper position in a forward part.

FIG. 4 is an explanatory view showing a state in which the opening/closing plate is seen rightward, obliquely and downward in a left, oblique and upper position in a forward part.

Figure 5:
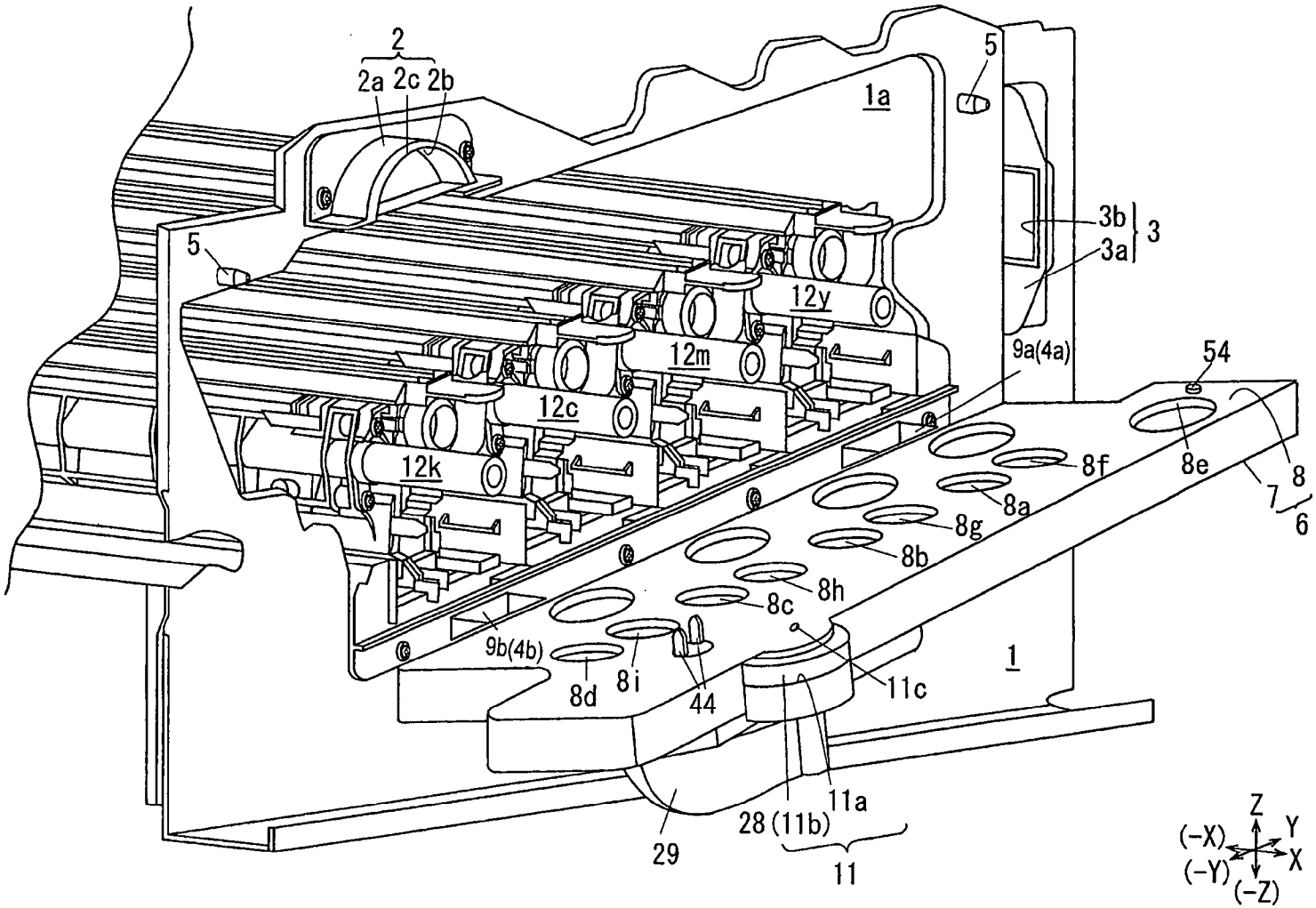
FIG. 5 is an explanatory view showing a state in which the opening/closing plate in the condition of FIG. 4 is moved to a coupling releasing position.

FIG. 5 is an explanatory view showing a state in which the opening/closing plate is moved to a decoupling position in the condition of FIG. 4 so that the belt module is removed.

In FIGS. 3 and 5, an opening I a is formed on a frame member 1 of the device body U2 according to the first example. The opening la serves to open front ends of the belt module BM, the photosensitive members PRy to PRk, and the chargers CRy to CRk. In FIGS. 3 to 5, moreover, an upper lock 2 according to an example of a first opening control member is supported in an upper part on a left side of the opening 1*a*. The upper lock 2 has a plate-shaped upper lock body 2*a* according to an example of an opening control member body which is fixedly supported on the frame member 1. Moreover, a cut part 2*b* and a first controlling portion 2*c* are formed in a central part of the upper lock body 2*a*. The cut part 2*b* takes an upward convex and arcuate shape. The first controlling portion 2*c* is disposed in a forward part from the cut part 2*b* and is concentric with the cut part 2*b*, and has a small diameter and takes a shape of a partial ring.

In FIG. 5, furthermore, a right lock 3 according to an example of a second opening control member is formed on a right end of the frame member 1. A second controlling portion 3*a* is formed on the right lock 3. The second controlling portion 3*a* is fixedly supported on the frame member 1 and surrounds a forward part of the frame member 1. A through hole 3*b* is formed between the frame member 1 and the second controlling portion 3*a*. In addition, shaft members 4*a* and 4*b* extended in a transverse direction are supported at an interval below the opening 1*a*. In FIGS. 3 and 5, moreover, positioning pins 5 and 5 according to an example of a first opening/closing positioning portion protruded forward are supported on both of left and right ends of the frame member 1. In the first example, the positioning pin 5 on a left side is disposed in an upper part on a left end of the opening 1*a* and the positioning pin 5 on a right side is disposed in a right part on an upper right end of the opening 1*a*.

Figure 6:
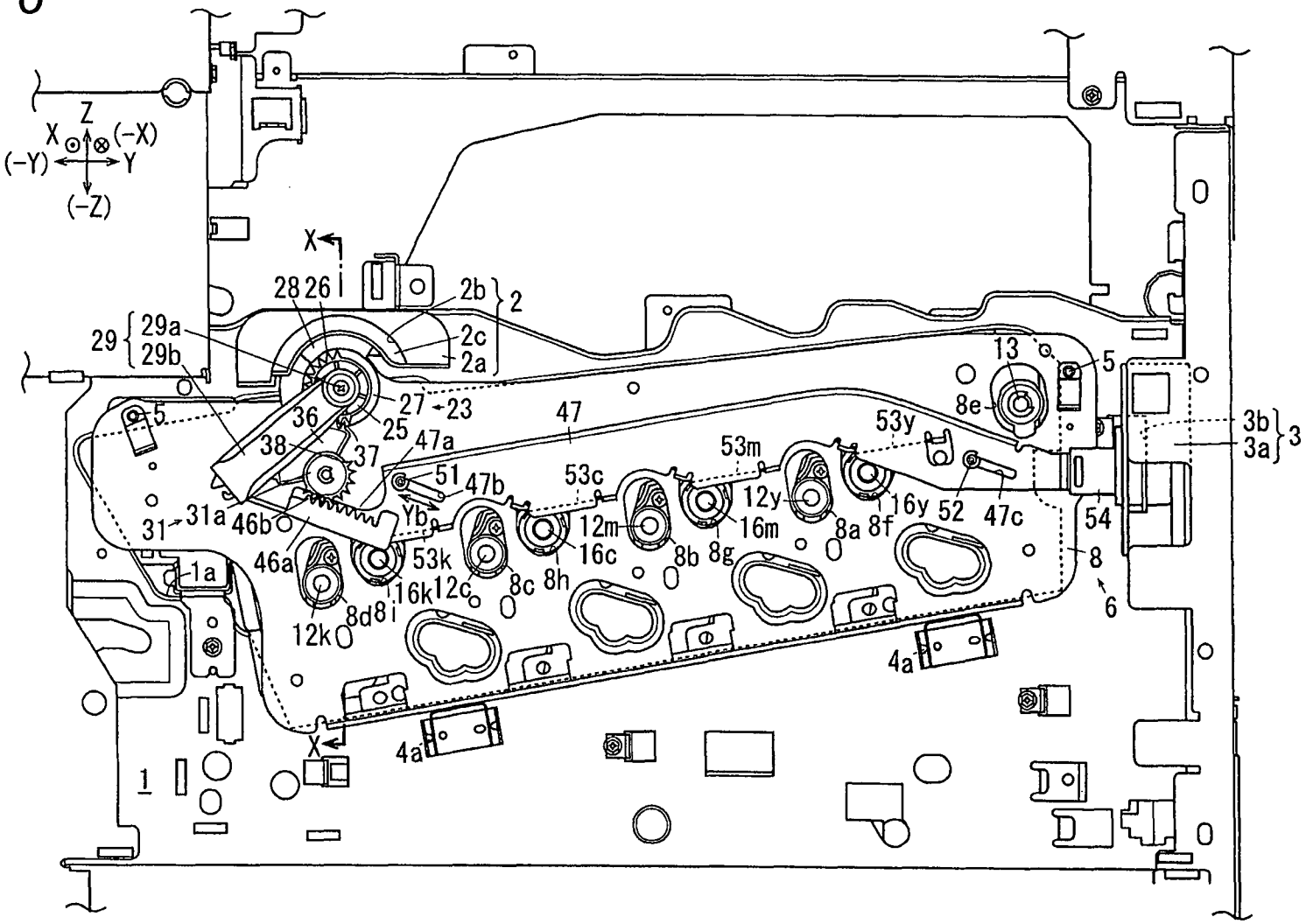
FIG. 6 is an enlarged explanatory view showing a main part of a photosensitive member positioning mechanism of the opening/closing plate attached to the frame member, illustrating the opening/closing plate in a state in which the front wall member is omitted from the condition of FIG. 3.

FIG. 6 is an enlarged explanatory view showing a main part of a photosensitive member positioning mechanism of the opening/closing plate which is attached to the frame member, illustrating the opening/closing plate in a state in which the front wall member is omitted in the condition of FIG. 3.

Figure 7A:
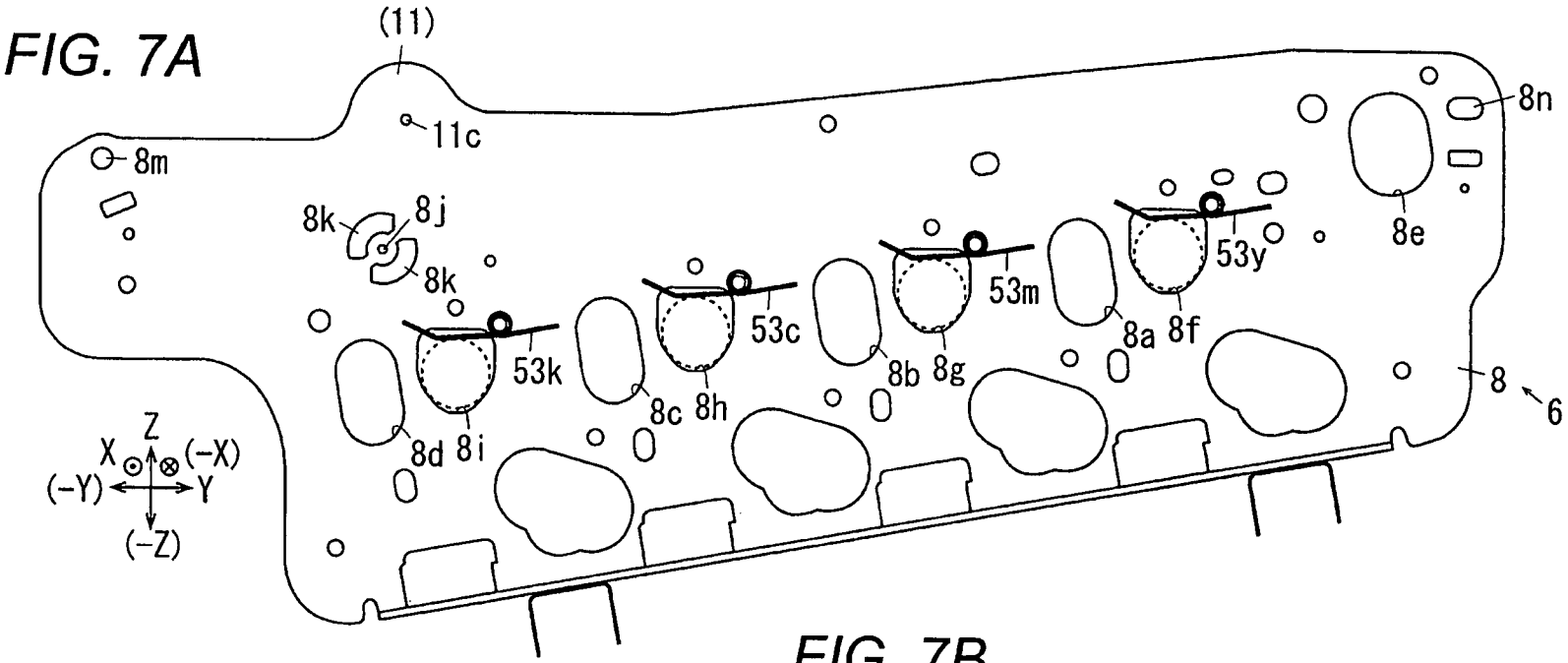
FIG. 7 is an enlarged explanatory view showing a rear wall member of the opening/closing plate according to the first example, FIG. 7A being an enlarged explanatory view showing the rear wall member and FIG. 7B being an enlarged explanatory view showing a state in which an axial end of a photosensitive member is supported by the rear wall member and a torsion spring.
Figure 7B:
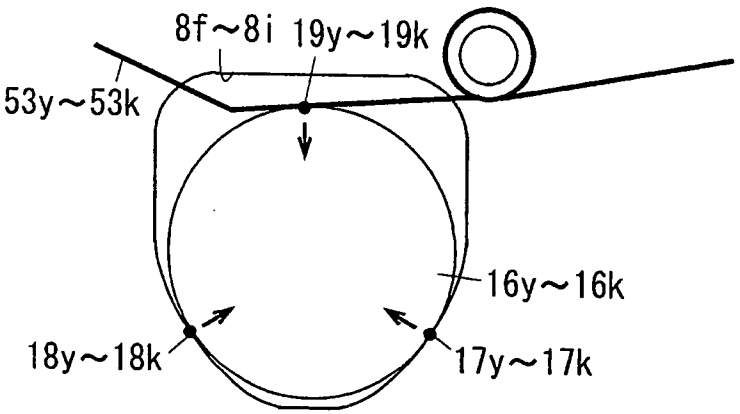

FIG. 7 is an explanatory view showing a rear wall member of the opening/closing plate according to the first example, and FIG. 7A is an enlarged explanatory view showing the rear wall member and FIG. 7B is an enlarged explanatory view showing a state in which an axial end of the photosensitive member is supported by the rear wall member and a torsion spring.

In FIGS. 3 to 6, moreover, an opening/closing plate 6 according to an example of an operation enabling member in accordance with the first example is supported in a forward part of the frame member 1 according to the first example. In FIGS. 3 to 5, the opening/closing plate 6 according to the first example has a front wall member 7 according to an example of a front opening/closing member and a rear wall member 8 according to an example of a rear opening/closing member which is fixedly supported on the front wall member 7. In addition, shaft supported portions 9*a* and 9*b* supported rotatably on the shaft members 4*a* and 4*b* are formed on a lower end of the front wall member 7. In other words, the opening/closing plate 6 is supported on the frame member 1 so as to enable opening/closing operations with the shaft members 4*a* and 4*b* set to be rotating centers.

Moreover, a gear housing portion 11 according to an example of a toothed wheel housing portion is formed on an upper end at a left side of the opening/closing plate 6. The gear housing portion 11 is formed corresponding to the first controlling portion 2*c* and takes a convex shape. A notch portion 11*a* cut along an outer periphery of the gear housing portion 11 at the front wall member 7 side is formed on an upper end at a rear side of the gear housing portion 11 as shown in FIG. 5, and a second opening 11*b* is formed between the notch portion 11*a* and the rear wall member 8. Furthermore, a first rotating through hole 11*c* penetrating the rear wall member 8 in a longitudinal direction is formed on a central part of the gear housing portion 11 as shown in FIG. 7A.

In addition, first front discharging through holes 7*a* to 7*d* are formed on a central part of the front wall member 7. First discharging paths 12*y* to 12*k* extended forward from the photosensitive member cleaners CLy to CLk and serving to discharge the developers collected by the photosensitive member cleaners CLy to CLk penetrate the first front discharging through holes 7*a* to 7*d*. Moreover, a second front discharging through hole 7*e* is formed on a right end of the front wall member 7. A second discharging path 13 extended forward from the belt cleaner CLb and serving to discharge the developer collected by the belt cleaner CLb penetrates the second front discharging through hole 7*e*.

In FIG. 7, furthermore, first rear discharging through holes 8*a* to 8*d* and a second rear discharging through hole 8*e* are formed in opposed positions to the front discharging through holes 7*a* to 7*d* and 7*e* over the rear wall member 8.

In other words, the discharging paths 12*y* to 12*k* and 13 according to the first example penetrate the discharging through holes (7*a* to 7*d*, 8*a* to 8*d*) and (7*e*, 8*e*) of the opening/closing plate 6. The respective discharging paths 12*y* to 12*k* and 13 are connected to a collecting container (not shown) disposed on a front side of the opening/closing plate 6 so that the developer is collected.

Moreover, photosensitive member through holes 8*f* to 8*i* are formed on right parts of the first rear discharging through holes 8*a* to 8*d*. Shaft ends 16*y* to 16*k* of the photosensitive members PRy to PRk penetrate the photosensitive member through holes 8*f* to 8*i*. Furthermore, a second rotating through hole 8*j* penetrating in a longitudinal direction is formed on a central part at a left side of the rear wall member 8. In addition, coupling through holes 8*k* and 8*k* are formed opposite to each other in an outer part of the second rotating through hole 8*j*. The coupling through holes 8*k* and 8*k* surround the second rotating through hole 8*j* and penetrate in the longitudinal direction, and take a shape of a semicircular arc. Moreover, a positioning through hole 8*m* according to an example of a first opening/closing positioned portion is formed on an upper end at the left side of the rear wall member 8. The positioning pin 5 on the left side penetrates the positioning through hole 8*m*. Furthermore, a positioning through slot 8*n* according to an example of a second opening/closing positioned portion is formed on an upper end at a right side of the rear wall member 8. The positioning pin 5 on the right side penetrates the positioning through slot 8*n*.

(Explanation of Upper Lock Gear 23 According to First Example)

Figure 8:
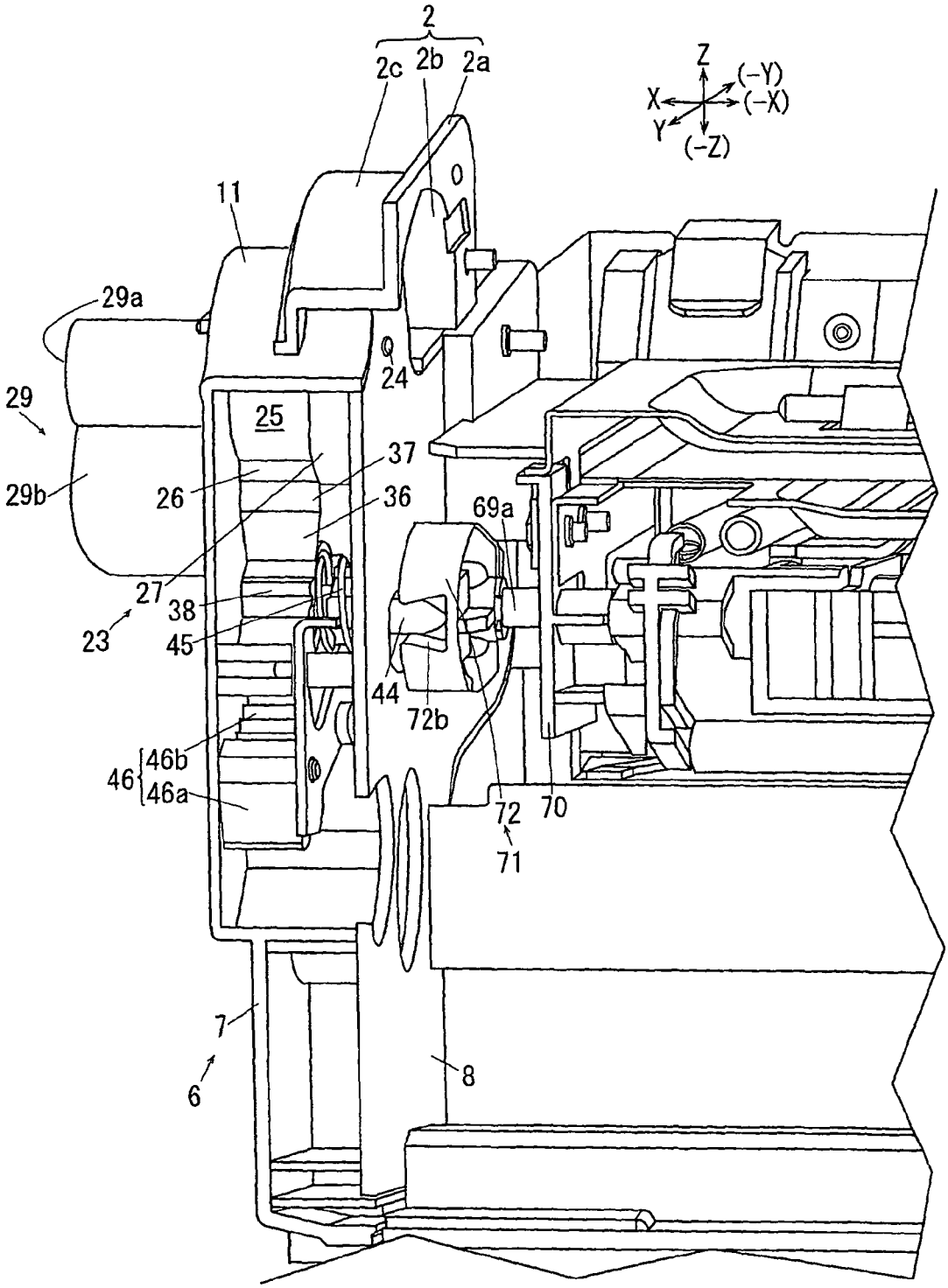
FIG. 8 is an explanatory view showing a handle according to the first example and is a sectional view taken along a VIII-VIII line in FIG. 3.

FIG. 8 is an explanatory view showing a handle according to the first example and is a sectional view taken along a VIII-VIII line in FIG. 3.

Figure 9:
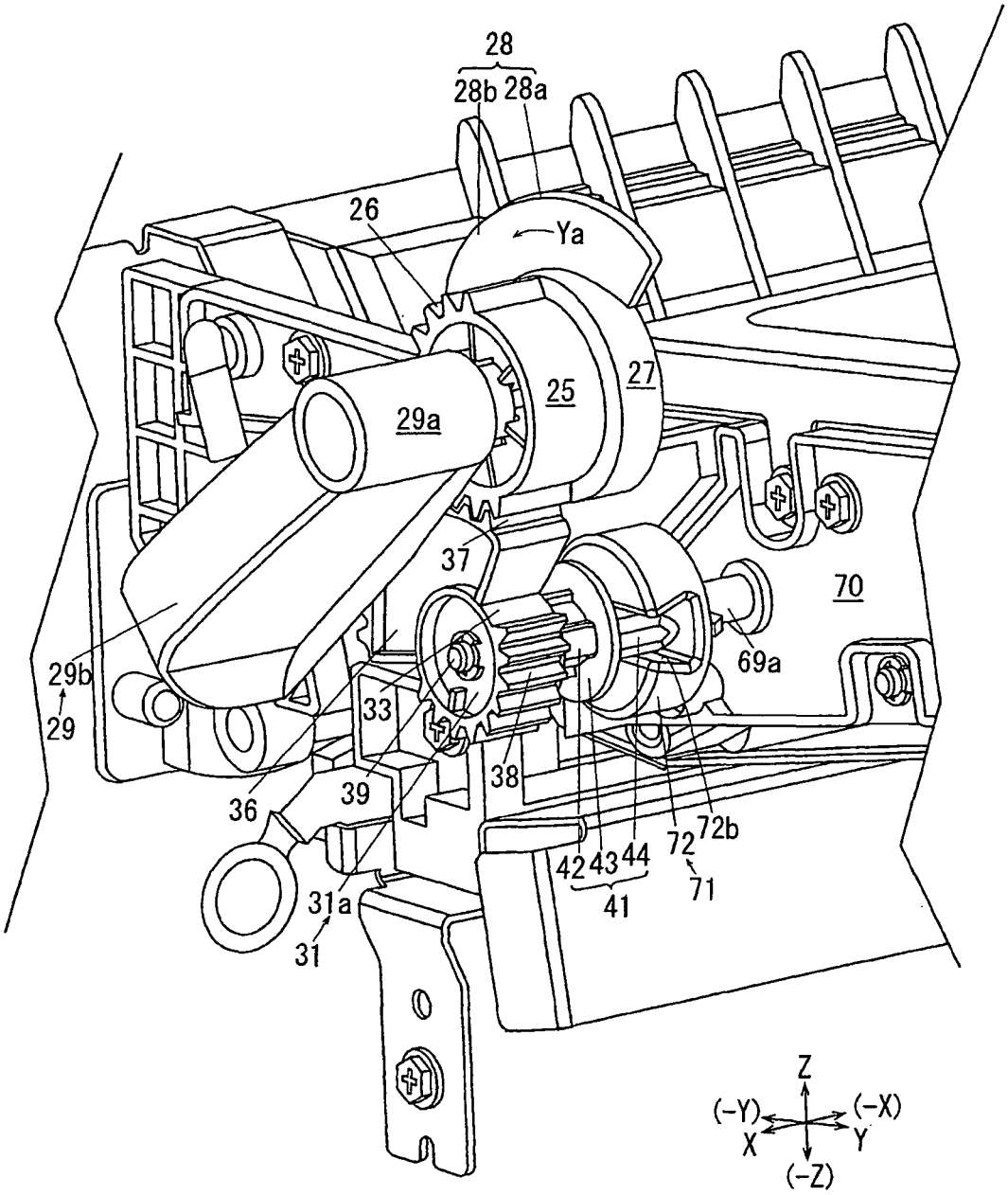
FIG. 9 is an explanatory view related to an engagement of a coupling according to the first example and is a perspective enlarged explanatory view showing the handle in which the front wall member and the rear wall member in the opening/closing plate are omitted.

FIG. 9 is an explanatory view related to an engagement of a coupling according to the first example and is a perspective enlarged explanatory view showing the handle in which the front wall member and the rear wall member in the opening/closing plate are omitted.

Figure 10:
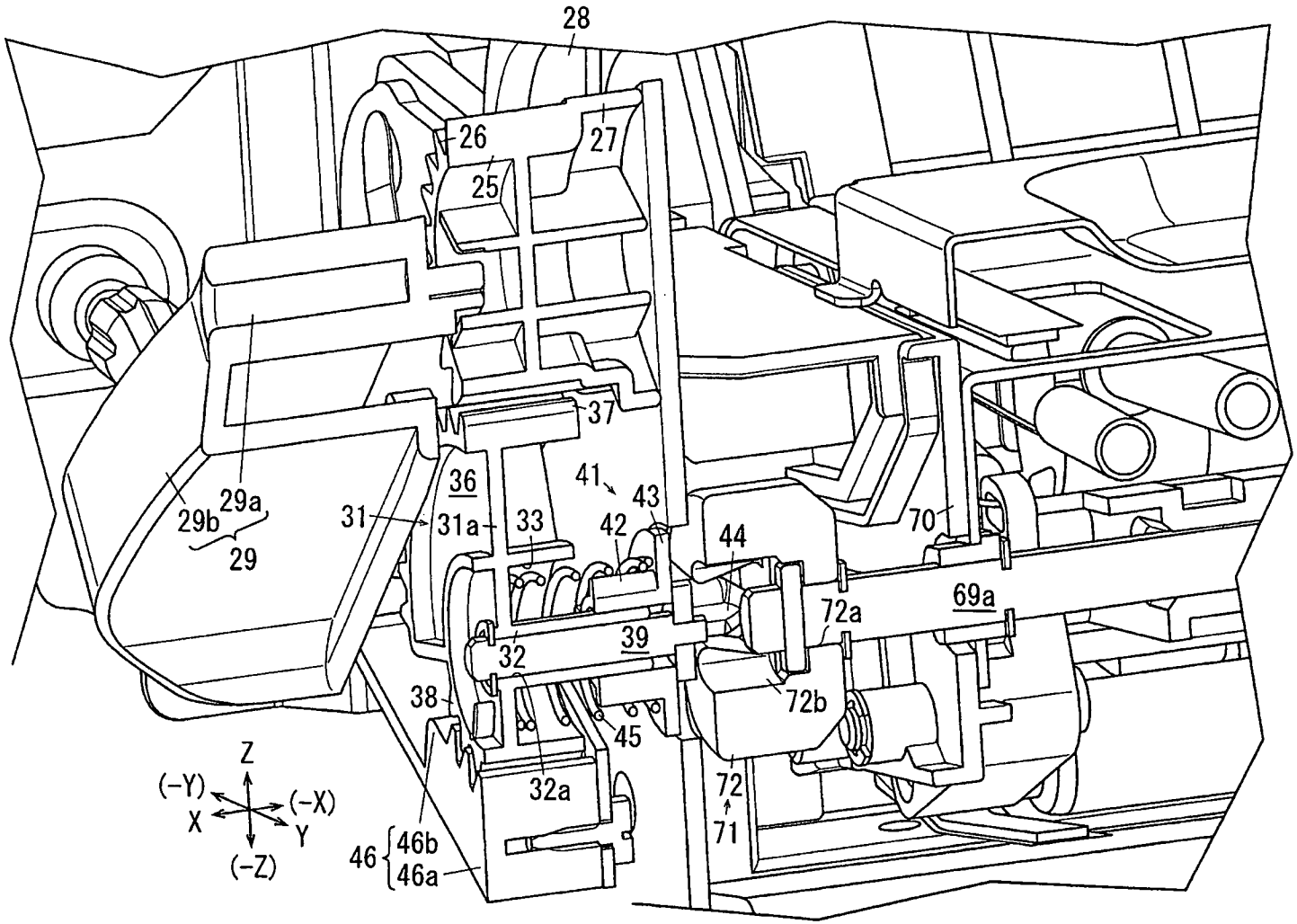
FIG. 10 is an explanatory view showing an elastic spring according to the first example and is a sectional view taken along an X-X line in FIG. 6.

FIG. 10 is an explanatory view showing an elastic spring according to the first example and is a sectional view taken along an X-X line in FIG. 6.

In FIG. 6, an upper lock gear 23 according to an example of an upper transmitting member is accommodated in the gear housing portion 11. In FIG. 8, the upper lock gear 23 is supported on a rear pin 24 according to an example of a rear rotating shaft which is rotatably supported on the first rotating through hole 11*c* of the rear wall member 8. In FIG. 9, a small diameter portion 25 taking a cylindrical shape is formed on a front side of the upper lock gear 23, and an upper gear portion 26 according to an example of a first toothed wheel is formed corresponding to a half circumference over an outer peripheral surface of the small diameter portion 25.

Moreover, a large diameter portion 27 is formed on a rear side of the upper lock gear 23. The large diameter portion 27 has a larger diameter than the small diameter portion 25, is coaxial with the small diameter portion 25 and takes a cylindrical shape. A fan-shaped upper lock cam 28 according to an example of a first controlled portion is formed on an outer peripheral surface of the large diameter portion 27. The upper lock cam 28 is formed corresponding to the cut portion 2*b* and is fitted between the cut portion 2*b* and the first controlling portion 2*c*. In FIG. 9, the upper lock cam 28 is provided with a guiding portion 28*a* and a locked portion 28*b*. As seen from a forward part, the guiding portion 28*a* is formed to have a width in a longitudinal direction increased from a right end toward a central part in a counterclockwise direction Ya and the locked portion 28*b* is formed to have a constant width in the longitudinal direction from the central part to a left end in the counterclockwise direction Ya.

(Explanation of Handle 29 According to First Example)

In FIGS. 3 to 6 and FIGS. 8 to 10, moreover, a handle 29 according to an example of an operating portion which may be rotated by an operation of an operator is fixedly supported on a front end of the small diameter portion 25. In FIGS. 9 and 10, the handle 29 according to the first example has a handle shaft 29*a* according to an example of a front rotating shaft which penetrates a through hole (not shown) of the front wall member 7 and is fixedly supported on the small diameter portion 25. Furthermore, the handle 29 has a gripping portion 29*b* which is extended in a radial direction from a front end of the handle shaft 29*a* disposed in a forward part of the front wall member 7 and may be gripped by the operator. Accordingly, the handle 29 and the upper lock gear 23 are supported to be integrally rotatable with the rear pin 24 set to be a rotating center. When the handle 29 is rotated, the upper lock gear 23 is also rotated.

(Explanation of Lower Coupling Gear 31 According to First Example)

In FIGS. 6 and 8 to 10, furthermore, a lower coupling gear 31 according to an example of a lower transmitting member is disposed in a space between the front wall member 7 and the rear wall member 8 below the upper lock gear 23. In FIG. 10, the lower coupling gear 31 according to the first example has a gear body 31*a* taking a shape of a circular plate according to an example of a toothed wheel body. A cylindrical coupling support portion 32 extended rearward from a rear surface is formed in a central part of the gear body 31*a*, and a shaft through hole 32*a* penetrating in a longitudinal direction is formed in an inner part of the coupling support portion 32. A cylindrical spring housing portion 33 which is concentric with the coupling support portion 32 is formed on a rear surface of the gear body 31*a* around the shaft through hole 32*a*. A fan plate 36 taking a shape of a fan around the shaft through hole 32*a* is formed on an outer peripheral surface of the gear body 31*a*, and an intermediate gear portion 37 according to an example of a second toothed wheel to be engaged with the upper gear portion 26 is formed on an outer peripheral surface of the fan plate 36. Moreover, a lower gear portion 38 according to an example of a third toothed wheel is formed corresponding to a half circumference in a position having a phase shifted from the fan plate 36 over an outer peripheral surface of the spring housing portion 32.

(Explanation of Front Coupling 41 According to First Example)

A lower rotating shaft 39 supported fixedly onto a second rotating through hole 19 penetrates the shaft through hole 32*a*, and the lower coupling gear 31 is rotatably supported on the lower rotating shaft 39. Moreover, a front coupling 41 according to an example of a first transmitting member which is movable in a longitudinal direction is supported on an outer peripheral surface of the coupling support portion 33. The front coupling 41 according to the first example has a cylindrical front coupling body 42 according to an example of a first transmitting member body which is caused to penetrate the coupling support portion 33 and is supported movably in the longitudinal direction.

A flange portion 43 according to an example of an edge part taking a shape of a circular plate is formed integrally with a rear end of the front coupling body 42. The flange portion 43 is disposed in a forward part of the rear wall member 8. In the first example, an outside diameter of the flange portion 43 is formed corresponding to that of the spring housing portion 32. Moreover, coupling click portions 44 and 44 according to an example of an engaging portion are formed integrally with a rear surface of the flange portion 43. The coupling click portions 44 and 44 are protruded rearward and may penetrate the coupling through holes 8*k* and 8*k*. The coupling click portions 44 and 44 according to the first example are disposed opposite to each other with the front coupling body 42 to be a central part of the flange portion 43 interposed therebetween.

(Explanation of Elastic Spring 45 According to First Example)

Furthermore, an elastic spring 45 according to an example of an energizing member penetrates the front coupling body 42 and the coupling support portion 32 and is thus supported in the spring housing portion 33 between a front surface of the flange portion 43 and a rear surface of the gear body 31*a*. Accordingly, the elastic spring 45 is caused to penetrate the lower rotating shaft 39 through the members 32 and 42 and is supported in this state. In the first example, the elastic spring 45 energizes the front coupling 41 rearward. In a state in which an external force does not act, accordingly, the front coupling 41 according to the first example comes in contact with a front surface of the rear wall member 8 on the rear surface of the flange portion 43 so that the coupling click portions 44 and 44 penetrate the coupling through holes 8*k* and 8*k* as shown in FIGS. 8 and 10.

(Explanation of Rack Gear 46 According to First Example)

In FIGS. 6 and 10, moreover, a rack gear 46 according to an example of a second transmitted member is supported in the space between the front wall member 7 and the rear wall member 8 below the lower coupling gear 31. The rack gear 46 has a rack 46*a* according to an example of a second transmitted member body extended in a direction of an arrow Yb tilted to a transverse direction and an example of a flat plate member. In addition, a gear portion 46*b* according to an example of a fourth toothed wheel to be engaged with the lower gear portion 38 is formed on an upper end face of the rack 46.

A second transmitting member (23+31) is constituted by the upper rock gear 23 and the lower coupling gear 31.

(Explanation of Positioning Plate 47 According to First Example)

Furthermore, a positioning plate 47 according to an example of a second positioning member and an example of a positioning member for an image holding member is disposed in the space between the front wall member 7 and the rear wall member 8 behind the rack gear 46. In FIG. 6, the positioning plate 47 according to the first example is formed to take a shape of a plate extended from a part provided above each of the through holes 8*a* to 8*d* and 8*f* to 8*i* in the rear wall member 8 to a part provided below the second rear discharging through hole 8*e*.

A rack support portion 47*a* according to an example of a flat plate member support portion for supporting the rack 46*a* is formed on a left end of the positioning plate 47. Moreover, a first through slot 47*b* extended in parallel with the rack 46*a* is formed in a right, oblique and upper part of the rack support portion 47*a*. In addition, a second through slot 47*c* extended in parallel with the first through slot 47*b* is formed on a right end of the positioning plate 47.

Plate support pins 51 and 52 according to an example of a positioning support member supported fixedly onto the rear wall member 8 penetrate the through holes 47*b* and 47*c* according to the first example. Accordingly, the positioning plate 47 is supported to be slidable in the direction of the arrow Yb by means of the plate support pins 51 and 52.

Moreover, first discharging notch portions 47*d* to 47*f* for opening upper ends of the first rear discharging through holes 8*b*, 8*c* and 8*d* for the respective colors of Y, M and C are formed in opposed positions to the first rear discharging through holes 8*b*, 8*c* and 8*d* at a lower end of the positioning plate 47.

In FIGS. 6 and 7, furthermore, torsion springs 53*y* to 53*k* according to an example of a photosensitive member energizing member for downward energizing the shaft ends 16*y* to 16*k* of the photosensitive members PRy to PRk in contact therewith are supported in corresponding positions to right, oblique and upper parts of the photosensitive members PRy to PRk over a rear surface of the positioning plate 47. In the first example, as shown in FIG. 7B, lower ends of the shaft ends 16*y* to 16*k* are supported on two points including right lower portions 17*y* to 17*k* and left lower portions 18*y* to 18*k* in the photosensitive member through holes 8*f* to 8*i*. Accordingly, upper portions 19*y* to 19*k* of the shaft ends 16*y* to 16*k* are pushed downward by the torsion springs 53*y* to 53*k* so that the shaft ends 16*y* to 16*k* are brought into a supporting state on three different points. As a result, the shaft ends 16*y* to 16*k* are supported in a state in which a force is received in three different directions and are thus positioned and fixed in a state in which an unsteadiness in a vertical or transverse direction is reduced.

Moreover, a second controlled member 54 extended toward the through hole 3*b* of the right lock 3 provided in a right part and taking a shape of a plate is supported on a right end of a front surface of the positioning plate 47.

(Explanation of Belt Positioning Mechanism BM2 According to First Example)

(Explanation of Link LN according to First Example)

Figure 11A:
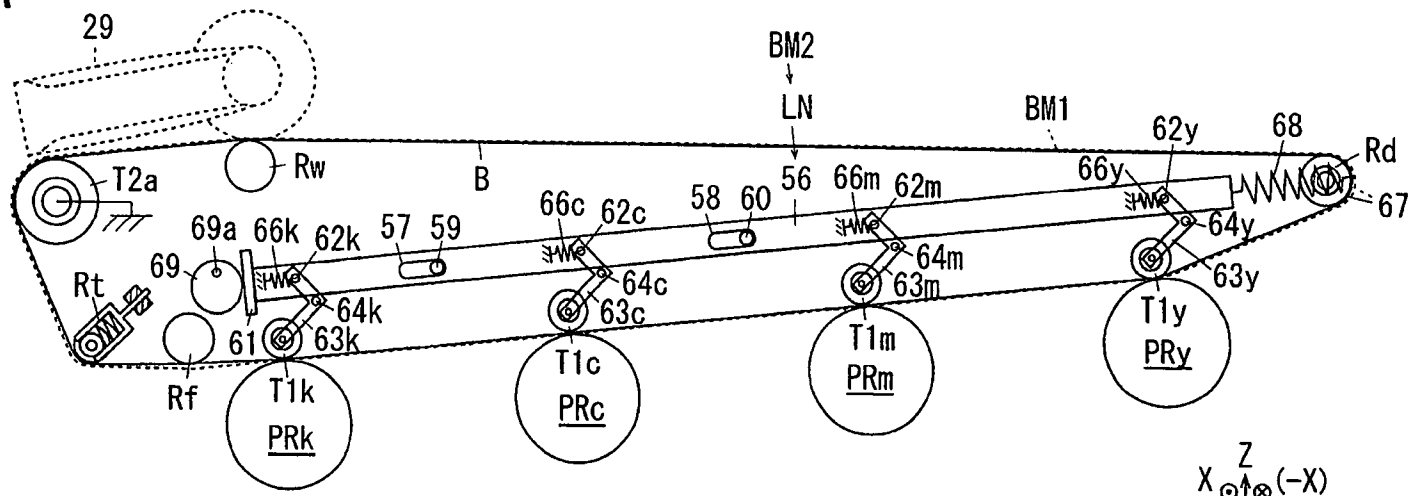
FIG. 11 is an enlarged explanatory view showing a main part of a belt positioning mechanism according to the first example, FIG. 11A being an explanatory view showing a state in which an intermediate transfer belt is moved to a contact position and FIG. 11B being an explanatory view showing a state in which the intermediate transfer belt is moved to a separating position.
Figure 11B:
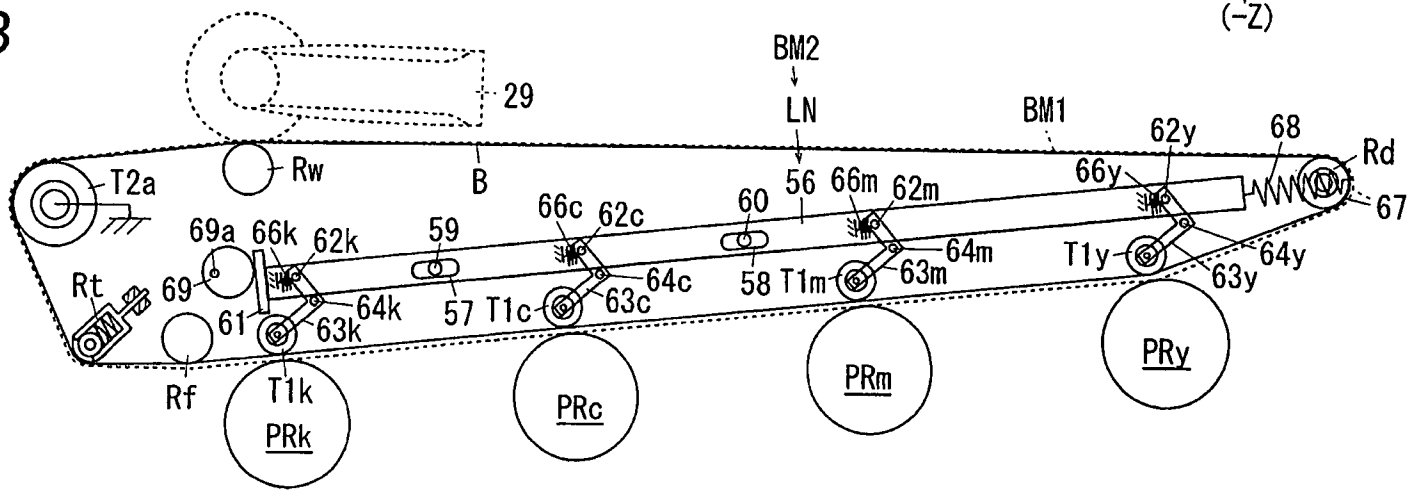

FIG. 11 is an enlarged explanatory view showing a main part of a belt positioning mechanism according to the first example, and FIG. 11A is an explanatory view showing a state in which an intermediate transfer belt is moved to a contact position and FIG. 11B is an explanatory view showing a state in which the intermediate transfer belt is moved to a separating position.

In FIG. 11, moreover, a link body 56 according to an example of an interlocking member body extended in a transverse direction is disposed in the intermediate transfer belt B according to the first example. Guiding slots 57 and 58 extended in the transverse direction are formed on a central part of the link body 56 according to the first example, and body support pins 59 and 60 according to an example of a body support portion supported on a frame member BM1 of the belt module BM shown in FIGS. 8 to 11 penetrate the guiding slots 57 and 58. Accordingly, the link body 56 according to the first example is supported to be slidable in the transverse direction by means of the body support pins 59 and 60.

Moreover, a plate-shaped cam engaging portion 61 according to an example of an eccentric engaging portion is formed on a left end of the link body 56. Coupling shafts 62*y* to 62*k* are supported at an interval in corresponding positions to parts provided above the primary transfer units T1*y* to T1*k* in a right part of the cam engaging portion 61.

Furthermore, arms 63*y* to 63*k* according to an example of an almost L-shaped interlocking arm portion are disposed between the link body 56 and the primary transfer units T1*y* to T1*k*. Central parts of the arms 63*y* to 63*k* according to the first example are rotatably supported by interlocking rotating shafts 64*y* to 64*k* supported on the frame member BM1. In addition, each of the arms 63*y* to 63*k* has one of ends supported on each of the coupling shafts 62*y* to 62*k* and has the other end supported on a rotating shaft of each of the primary transfer units T1*y* to T1*k*.

In addition, tension springs 66*y* to 66*k* according to an example of a tension applying member are supported between the arms 63*y* to 63*k* and the link body 56. Each of the tension springs 66*y* to 66*k* has one of ends supported on each of the coupling shaft 62*y* to 62*k* sides of the arms 63*y* to 63*k*, and pulls each of the arms 63*y* to 63*k* leftward. Moreover, a body pressing spring 68 according to an example of a body pressing member for pressing the link body 56 leftward is supported between the left end of the link body 56 and a left end wall 67 of the frame member BM1.

A link LN according to an example of an interlocking member is constituted by the respective members 56 to 61, 62*y* to 62*k*, 63*y* to 63*k*, 64*y* to 64*k*, 66*y* to 66*k*, and 68.

Furthermore, an eccentric cam 69 according to an example of an eccentric rotating member is disposed in a left part of the cam engaging portion 61. The eccentric cam 69 according to the first example is formed to take a sectional shape of a circular plate, and an eccentric rotating shaft 69*a* of the eccentric cam 69 is rotatably supported on the frame member BM1.

(Explanation of Rear Coupling 71 According to First Example)

In FIGS. 8 to 10, moreover, the eccentric rotating shaft 69*a* penetrates a front end wall 70 of the frame member BM1 and is extended forward, and a rear coupling 71 according to an example of a first transmitted member is supported on a front end of the eccentric rotating shaft 69*a*.

The rear coupling 71 according to the first example has a rear coupling body 72 according to an example of a first transmitted member body. A shaft through hole 72*a* penetrated by the eccentric rotating shaft 69*a* is formed on a central part of the rear coupling body 72, and the eccentric rotating shaft 69*a* is prevented from slipping out in a state in which it penetrates the shaft through hole 72*a*.

In addition, a coupling engaging groove 72*b* according to an example of an engaged portion is formed on a front end of the rear coupling body 72. The coupling engaging groove 72*b* is extended in a radial direction to pass the shaft through hole 72*a*. The coupling engaging groove 72*b* is formed to have such a width that the coupling click portions 44 and 44 are fitted therein.

In the first example, in the case in which an extending direction of the coupling engaging groove 72*b* is coincident with a direction of a straight line connecting the coupling click portions 44 and 44 to each other, therefore, the coupling engaging groove 72*b* is engaged with the coupling click portions 44 and 44 so that the front coupling 41 and the rear coupling 71 are coupled to each other.

In the first example, the eccentric cam 69 is disposed in such a manner that an eccentric direction of a straight line connecting a center of a sectional circle of the eccentric cam 69 and the eccentric rotating shaft 69*a* is orthogonal to the extending direction of the coupling engaging groove 72*b*.

A belt positioning mechanism BM2 according to an example of a first positioning member and an example of a positioning member for an intermediate transfer member is constituted by the members T1*y* to T1*k*, LN, 69 and 71.

(Explanation of Opening/Closing Lock of Opening/Closing Plate 6 According to First Example)

In a state in which the image forming operation shown in FIG. 6 is executed, the gripping portion 29*b* of the handle 29 is moved to a locking position according to an example of a first operating position which is extended rightward, obliquely and downward from the handle shaft 29*a*. At this time, the upper lock cam 28 of the upper lock gear 23 penetrates the second opening 11 b and is disposed in a state in which the locked portion 28*b* is fitted in a space between the cut portion 2*b* and the first controlling portion 2*c* in the upper lock 2.

Moreover, the positioning plate 47 is moved to a downward position according to an example of a second positioning position in which left ends of the through holes 47*b* and 47*c* come in contact with the plate support pins 51 and 52 through the gears 23, 31 and 46 and are thus moved rightward, obliquely and downward. At this time, the second controlled member 54 of the positioning plate 47 is disposed in a state in which it penetrates the through hole 3*b* of the right lock 3.

When the handle 29 is moved to the locking position, accordingly, the opening/closing plate 6 is controlled to be opened/closed with the shaft members 4*a* and 4*b* set to be rotating centers by means of the locked portion 28*b* and the controlled member 54. In other words, the operation for opening/closing the opening/closing plate 6 is locked.

(Explanation of Positioning of Member PRy to PRk and B According to First Example)

When the positioning plate 47 is moved to the downward position, moreover, the torsion springs 53*y* to 53*k* energize the photosensitive members PRy to PRk downward. For this reason, the photosensitive members PRy to PRk are positioned between the torsion springs 53*y* to 53*k* and the photosensitive member through holes 8*f* to 8*i*.

In the state in which the image forming operation is executed, furthermore, there is carried out a movement to a standby position in which the eccentric direction of the eccentric cam 69 is extended downward so that a rightward pressing force of the cam engaging portion 61 is minimized as shown in FIG. 11A. For this reason, the belt positioning mechanism BM2 is moved to a transfer pressing position according to an example of a first positioning position in which the link body 56 is pressed leftward by means of the body pressing spring 68 so that the body support pins 59 and 60 come in contact with right ends of the guiding slots 57 and 58.

At this time, the link LN moves the primary transfer units T1*y* to T1*k* downward through the arms 63*y* to 63*k*. For this reason, the intermediate transfer belt B is moved to a contact position in which it comes in contact with the photosensitive members PRy to PRk and the primary transfer units T1*y* to T1*k* are positioned in an opposing state to the photosensitive members PRy to PRk.

As a result, in the state in which the image forming operation is executed, the photosensitive members PRy to PRk and the intermediate transfer belt B are positioned by the positioning members 47 and BM2, and furthermore, the operation for opening/closing the opening/closing plate 6 is locked.

(Explanation of Unlocking of Opening/Closing Operation for Opening/Closing Plate 6 According to First Example)

Figure 12:
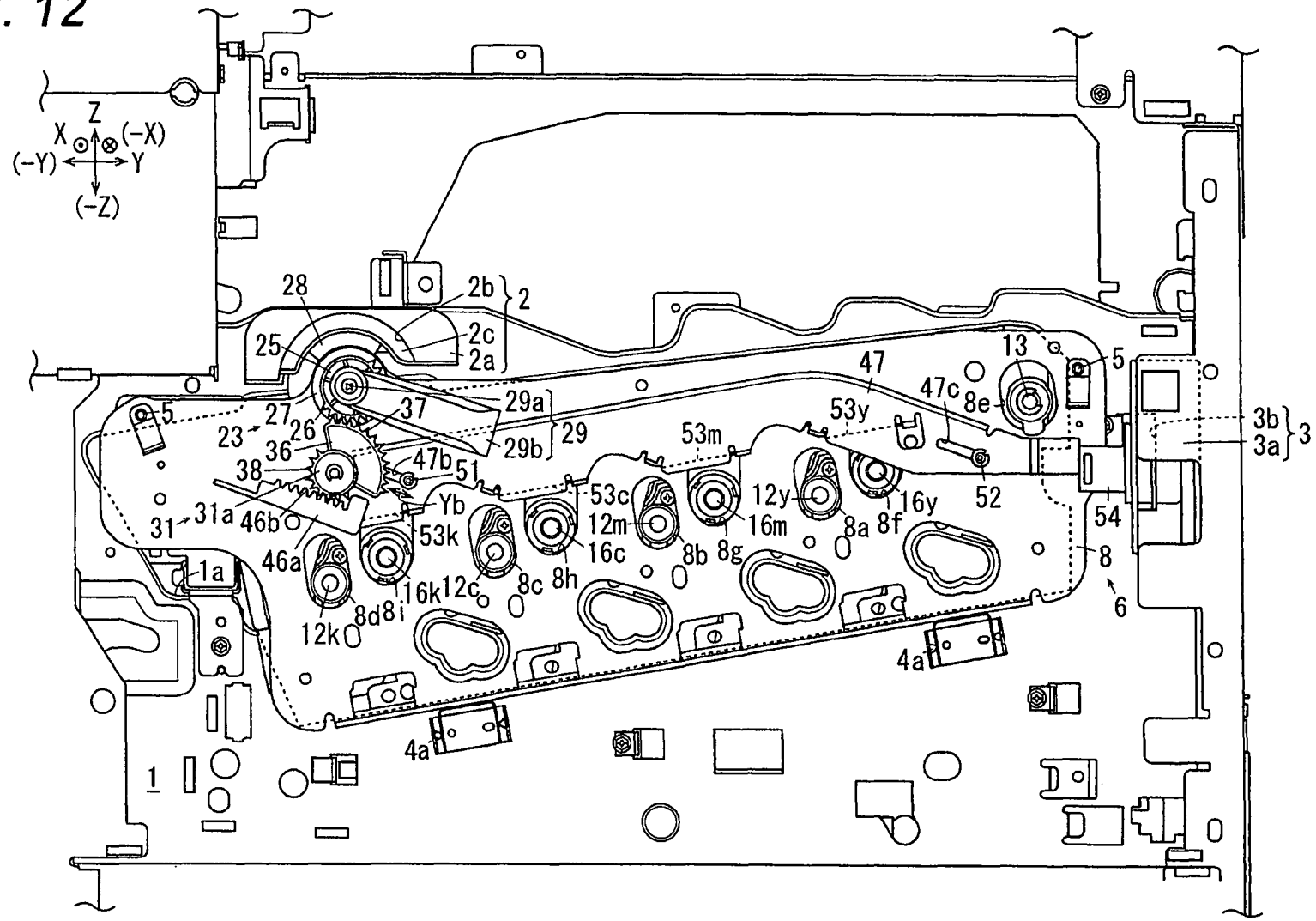
FIG. 12 is an explanatory view showing a state in which the handle is rotated in a counterclockwise direction in the condition of FIG. 6 to move a positioning plate from a downward position to an upward position.

FIG. 12 is an explanatory view showing a state in which the handle is rotated in a counterclockwise direction in the condition of FIG. 6 to move the positioning plate from a downward position to an upward position.

In FIGS. 11B and 12, moreover, when an operator grips and rotates the gripping portion 29*b* in the counterclockwise direction Ya with the handle shaft 29*a* set to be a rotating center, the handle 29 is moved to an unlocking position according to an example of a second operating position in which the gripping portion 29*b* is extended leftward from the handle shaft 29*a*. At this time, the upper lock cam 28 rotated integrally with the handle 29 is disposed in a state in which it slips out of the space of the upper lock 2 and is moved to an inner side of the opening/closing plate 6.

Furthermore, the positioning plate 47 is slid in the direction of the arrow Yb to an upward position according to an example of a second unlocking position in which right ends of the through holes 47*b* and 47*c* are moved leftward, obliquely and upward in contact with the plate support pins 51 and 52 through the gears 23, 31 and 46 as shown in FIG. 12. At this time, the second controlled member 54 is disposed in a state in which it slips out of the through hole 3*b* of the right lock 3 so that the penetration is released.

When the handle 29 is moved to the unlocking position, therefore, the operation for opening/closing the opening/closing plate 6 is unlocked so that the opening/closing plate 6 may be opened/closed by setting the shaft members 4*a* and 4*b* to be the rotating centers with respect to the frame member 1.

As a result, the opening/closing plate 6 may be moved between a coupling enabling position in which the opening 1*a* of the frame member 1 is blocked so that the couplings 41 and 71 may be coupled to each other as shown in FIG. 4 and a decoupling position in which the opening 1*a* is opened so that the couplings 41 and 71 are decoupled from each other as shown in FIG. 5.

In the first example, in the case in which the opening/closing plate 6 is moved to the decoupling position, the belt module BM or the photosensitive members PRy to PRk may be attached/removed in a longitudinal direction through the opening 1*a*.

(Explanation of Positioning Release of Member PRy to PRk and B According to First Example)

In the first example, in the case in which the positioning plate 47 is moved to the upward position, the torsion springs 53*y* to 53*k* are caused to separate from the photosensitive members PRy to PRk. As a result, the energization of the photosensitive members PRy to PRk from the torsion springs 53*y* to 53*k* is released so that the positioning of the photosensitive members PRy to PRk is released.

In the case in which the couplings 41 and 71 are coupled to each other, moreover, the eccentric rotating shaft 69*a* is rotated so that the eccentric cam 69 is rotated through the couplings 41 and 71 when the handle 29 is moved to the unlocking position. As a result, as shown in FIG. 11B, the eccentric cam 69 is moved to a pressing position in which the eccentric direction of the eccentric cam 69 is extended rightward so that a rightward pressing force of the cam engaging portion 61 is maximized. In the case in which the eccentric cam 69 is moved to the pressing position, the link body 56 is pressed rightward against a pressing force of the body pressing spring 68. At this time, the belt positioning mechanism BM2 is moved to a transfer retreating position according to an example of a first releasing position in which the body support pins 59 and 60 come in contact with the right ends of the guiding slots 57 and 58. At this time, the link LN moves the primary transfer units T1*y* to T1*k* upward through the arms 63*y* to 63*k*.

For this reason, the intermediate transfer belt B is moved to a separating position in which it is caused to separate from the photosensitive members PRy to PRk and the primary transfer units T1*y* to T1*k* are retreated from the photosensitive members PRy to PRk so that the positioning is released. In the first example, the intermediate transfer belt B moved to the separating position is laid with a smaller tension as compared with the case in which it is moved to the contact position by means of the respective rolls Rd, Rt, Rw, Rf, T2*a*, and T1*y* to T1*k*, and is supported in a separating state from the photosensitive members PRy to PRk.

As a result, when the handle 29 is moved to the unlocking position with the couplings 41 and 71 coupled to each other, the positioning of the photosensitive members PRy to PRk and the intermediate transfer belt B is released by the positioning members 47 and BM2 and the operation for opening/closing the opening/closing plate 6 is unlocked.

(Explanation of Coupling Cover 81 According to First Example)

Figure 13A:
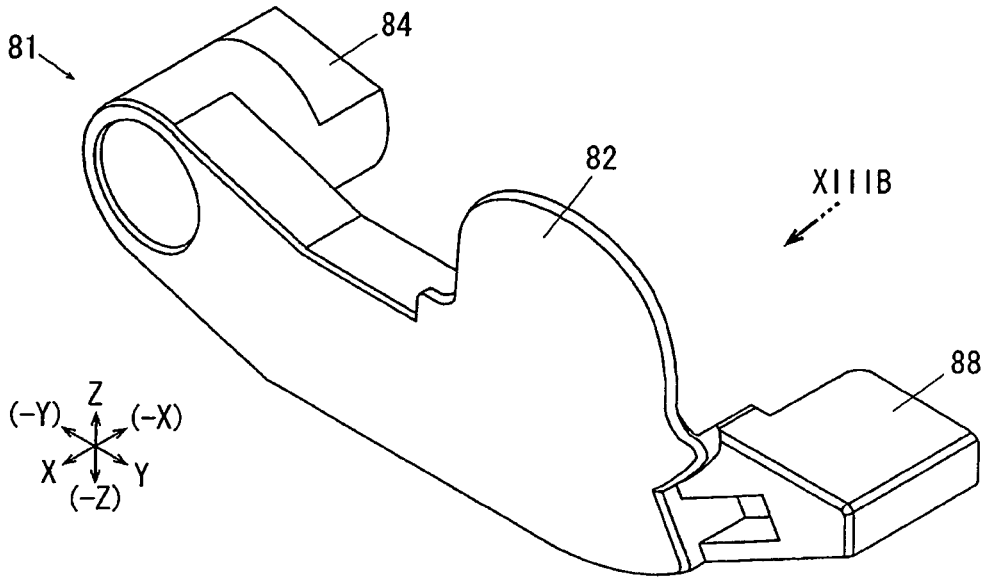
FIG. 13 is an explanatory view showing a coupling cover according to the first example, FIG. 13A being a perspective enlarged explanatory view showing the coupling cover and FIG. 13B being a perspective enlarged explanatory view showing the coupling cover seen in a direction of an arrow XIIIB in FIG. 13A.
Figure 13B:
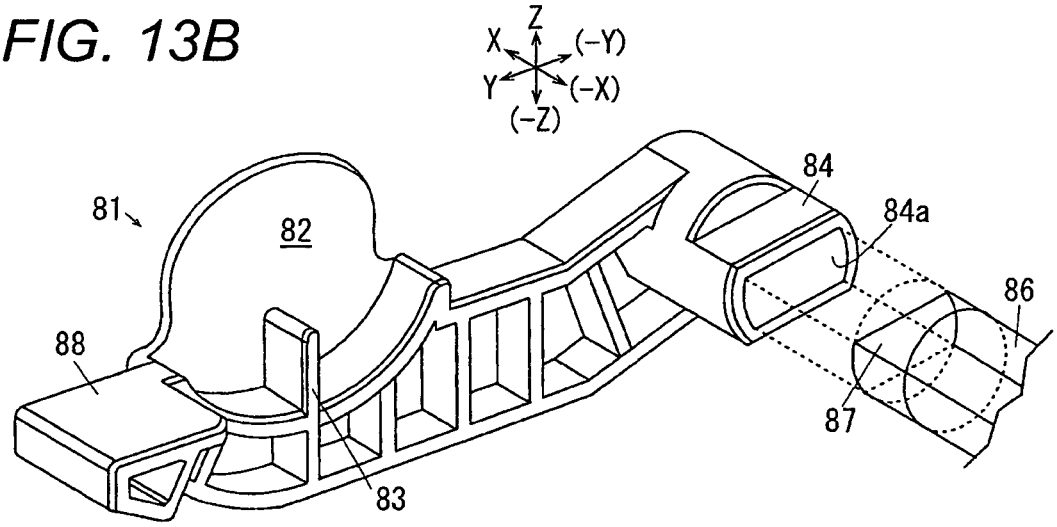

FIG. 13 is an explanatory view showing a coupling cover according to the first example, and FIG. 13A is a perspective enlarged explanatory view showing the coupling cover and FIG. 13B is a perspective enlarged explanatory view showing the coupling cover seen in a direction of an arrow XIIIB in FIG. 13A.

Figure 14:
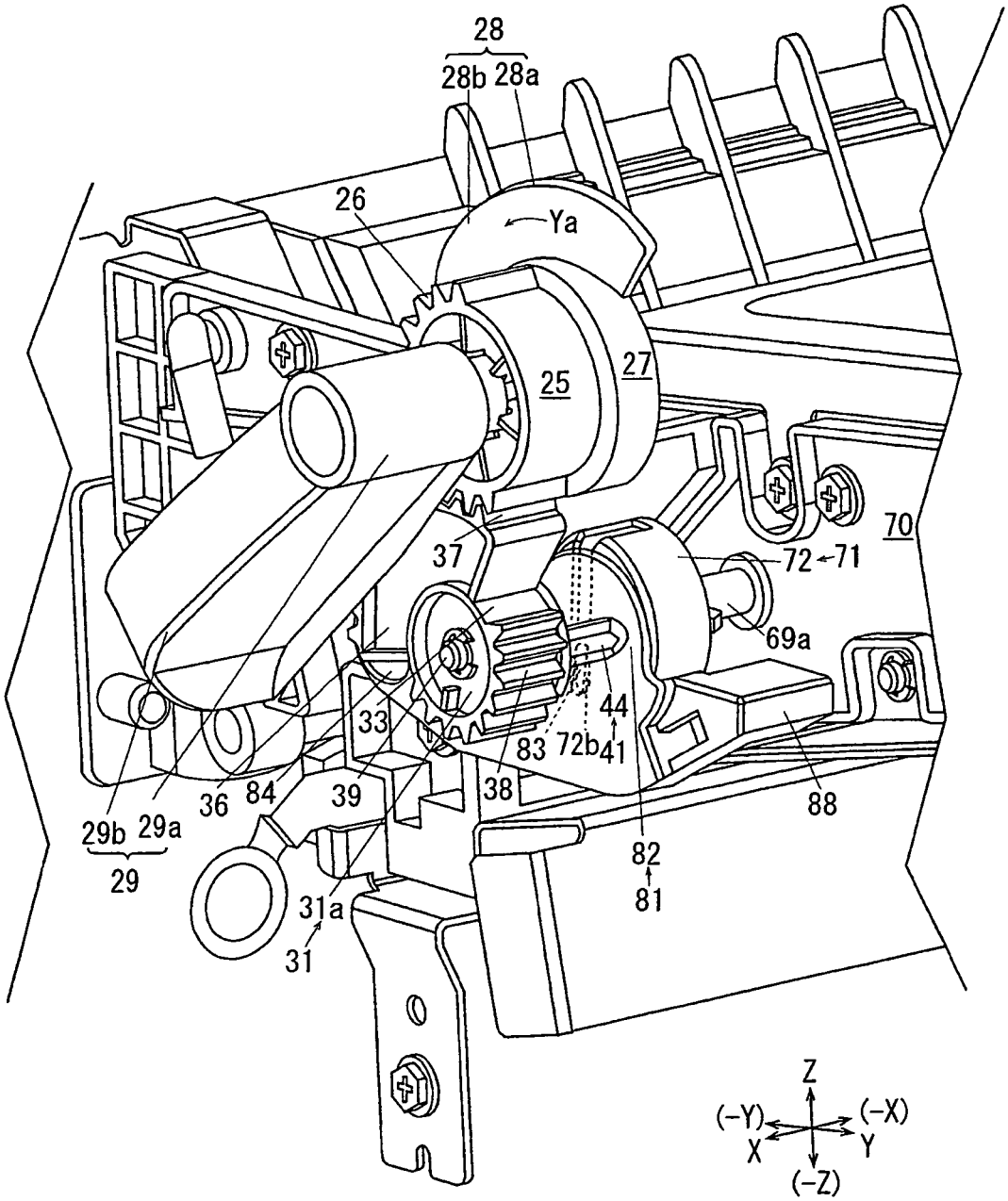
FIG. 14 is an explanatory view related to an engaging release of the coupling according to the first example corresponding to FIG. 9 and is a perspective enlarged explanatory view showing a state in which the coupling cover is attached to a rear coupling.

FIG. 14 is an explanatory view related to a disengagement of the coupling according to the first example corresponding to FIG. 9 and is a perspective enlarged explanatory view showing a state in which the coupling cover is attached to the rear coupling.

Figure 15:
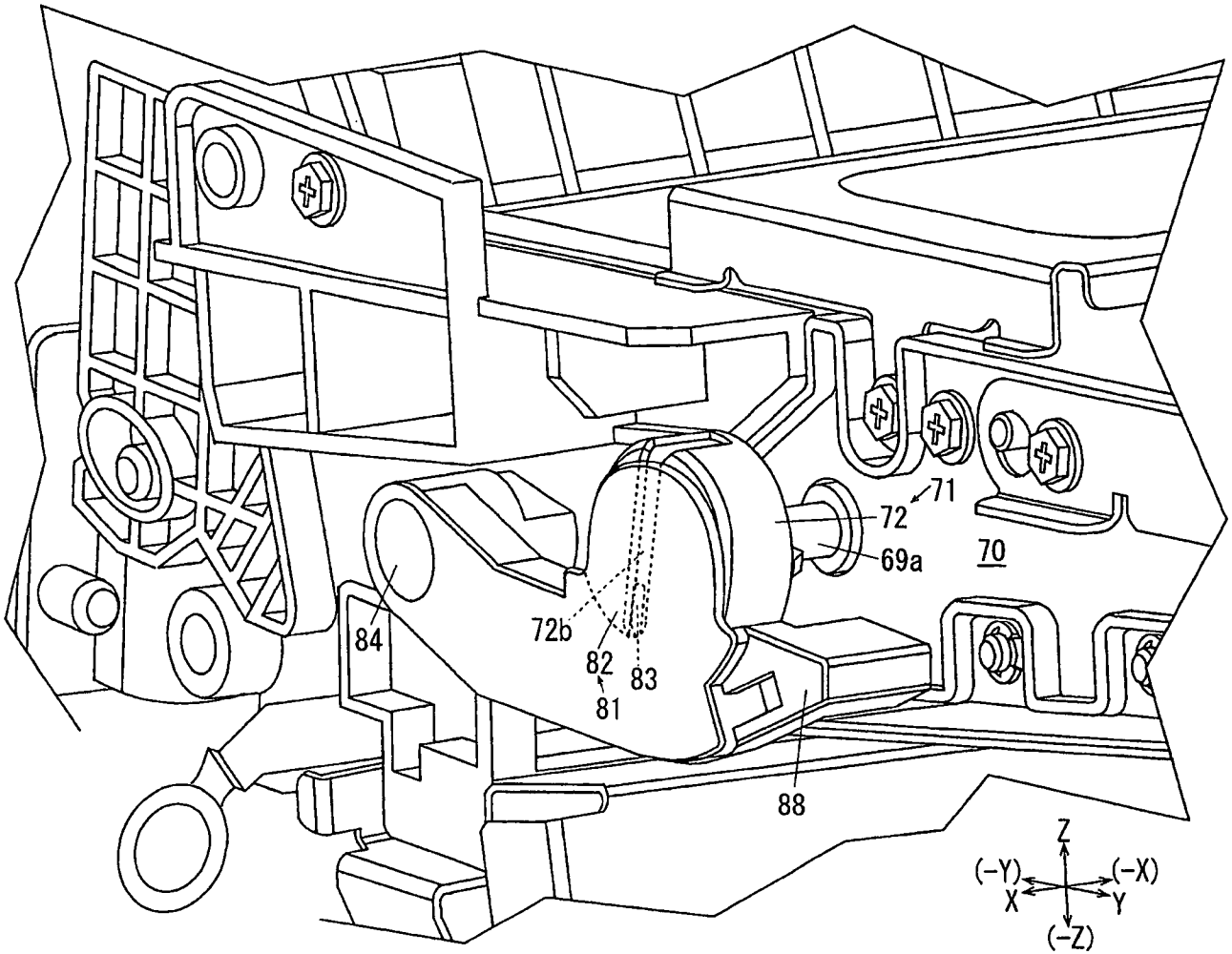
FIG. 15 is an explanatory view showing a state in which the handle and each gear are omitted from the condition of FIG. 14.

FIG. 15 is an explanatory view showing a state in which the handle and each gear are omitted from the condition of FIG. 14.

Figure 16:
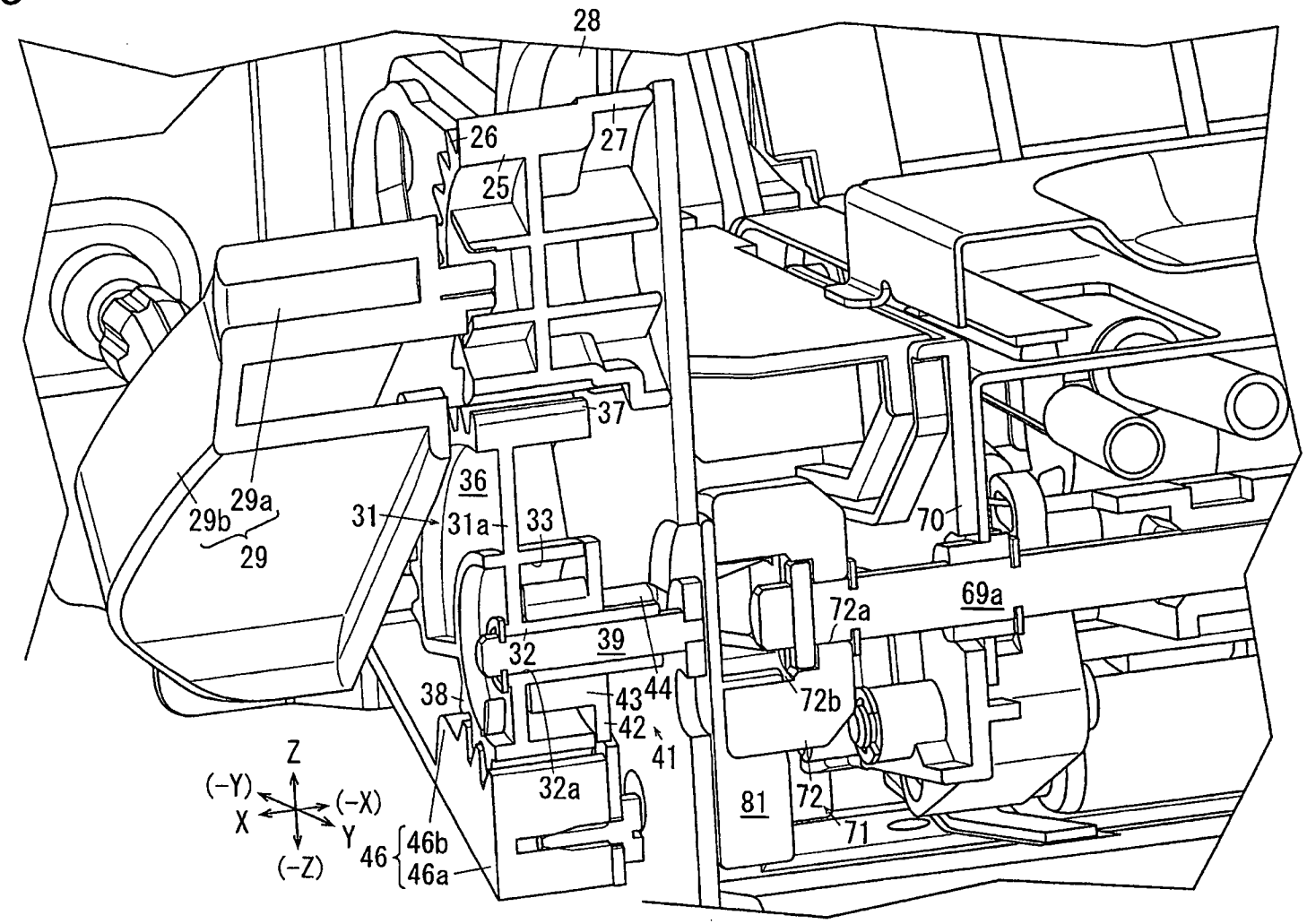
FIG. 16 is an explanatory view related to the engaging release of the coupling according to the first example corresponding to FIG. 10 and is a sectional view showing a state in which the coupling cover is attached to the rear coupling.

FIG. 16 is an explanatory view related to a disengagement of the coupling according to the first example corresponding to FIG. 10 and is a sectional view showing a state in which the coupling cover is attached to the rear coupling.

In FIGS. 13 to 16, moreover, a coupling cover 81 according to an example of a coupling controlling member may be attached/removed to/from the rear coupling 71 according to the first example.

In FIG. 13, a coupling controlling portion 82 taking a shape of an almost circular plate corresponding to a coupling surface of the rear coupling 71 is formed in a right part of the coupling cover 81 according to the first example. Moreover, a control engaging portion 83 protruded rearward is formed on a lower end of a rear surface of the coupling controlling portion 82. The control engaging portion 83 according to the first example is formed to take a shape of a thin plate extended in a vertical direction in such a width as to be fitted in the coupling engaging groove 72*b* in the case in which the coupling engaging groove 72*b* is disposed in an extending state in the vertical direction.

Moreover, a rotation controlling portion 84 extended rearward is formed on a left end of the coupling cover 81. As shown in FIG. 13B, a fitted portion 87 taking such a shape that both sides of an outer peripheral surface are cut out, that is, a double D cut shape is formed on a front end of a shaft end 86 of the backup roll T2*a* penetrating the front end wall 70 of the frame member BM1. Correspondingly, a fitting slot 84*a* which takes a shape of a slot and in which the fitted portion 87 is fitted is formed on a rear end of the rotation controlling portion 84 according to the first example.

Furthermore, a cover handle 88 according to an example of a control gripping portion protruded rearward is formed in a right part of the coupling controlling portion 82.

In the first example, the operator fits the fitted portion 87 in the fitting slot 84*a* and then rotates the coupling cover 81 in the counterclockwise direction Ya with the shaft end 86 set to be a rotating center in a state in which the cover handle 88 is gripped. At this time, if the coupling engaging groove 72*b* is disposed in an extending state in a vertical direction, the control engaging portion 83 is fitted in the coupling engaging groove 72*b* so that the coupling cover 81 is attached to the rear coupling 71 as shown in FIGS. 13 to 16 when the coupling controlling portion 82 is rotated to the rear coupling 71. The coupling cover 81 has such a structure that a rear end face of the cover handle 88 comes in contact with the front end wall 70 of the frame member BM1 to control a rearward movement of the coupling cover 81 if the cover handle 88 is pushed in so as not to excessively push a right side of the coupling cover 81 into the rear frame member BM1 side when the coupling cover 81 is to be attached to the rear coupling 71.

(Explanation of Decoupling of Coupling 41, 71 According to First Example)

In a state in which the coupling cover 81 is attached to the rear coupling 71, moreover, a front surface of the coupling controlling portion 82 blocks the coupling through holes 8*k* and 8*k* of the rear wall member 8 even if the opening/closing plate 6 is moved to the coupling enabling position as shown in FIG. 16. For this reason, the coupling click portions 44 and 44 of the front coupling 41 come in contact with a front surface of the coupling controlling portion 82 which blocks the coupling through holes 8*k* and 8*k*. Accordingly, the front coupling 41 is pressed forward against an energizing force of the elastic spring 45 and is thus moved to an inner side of the opening/closing plate 6. In the first example, accordingly, the coupling cover 81 is attached to the rear coupling 71 so that the couplings 41 and 71 are controlled to be coupled to each other.

As a result, the front coupling 41 may be moved between a transmission releasing position in which the coupling cover 81 is attached so that a transmission of an operation of the handle 29 is released as shown in FIGS. 14 to 16 and a transmission enabling position in which the coupling cover 81 is removed so that the operation of the handle 29 may be transmitted as shown in FIGS. 9 and 10.

(Explanation of Rotating Stop Detecting Means C1 According to First Example)

Figure 17:
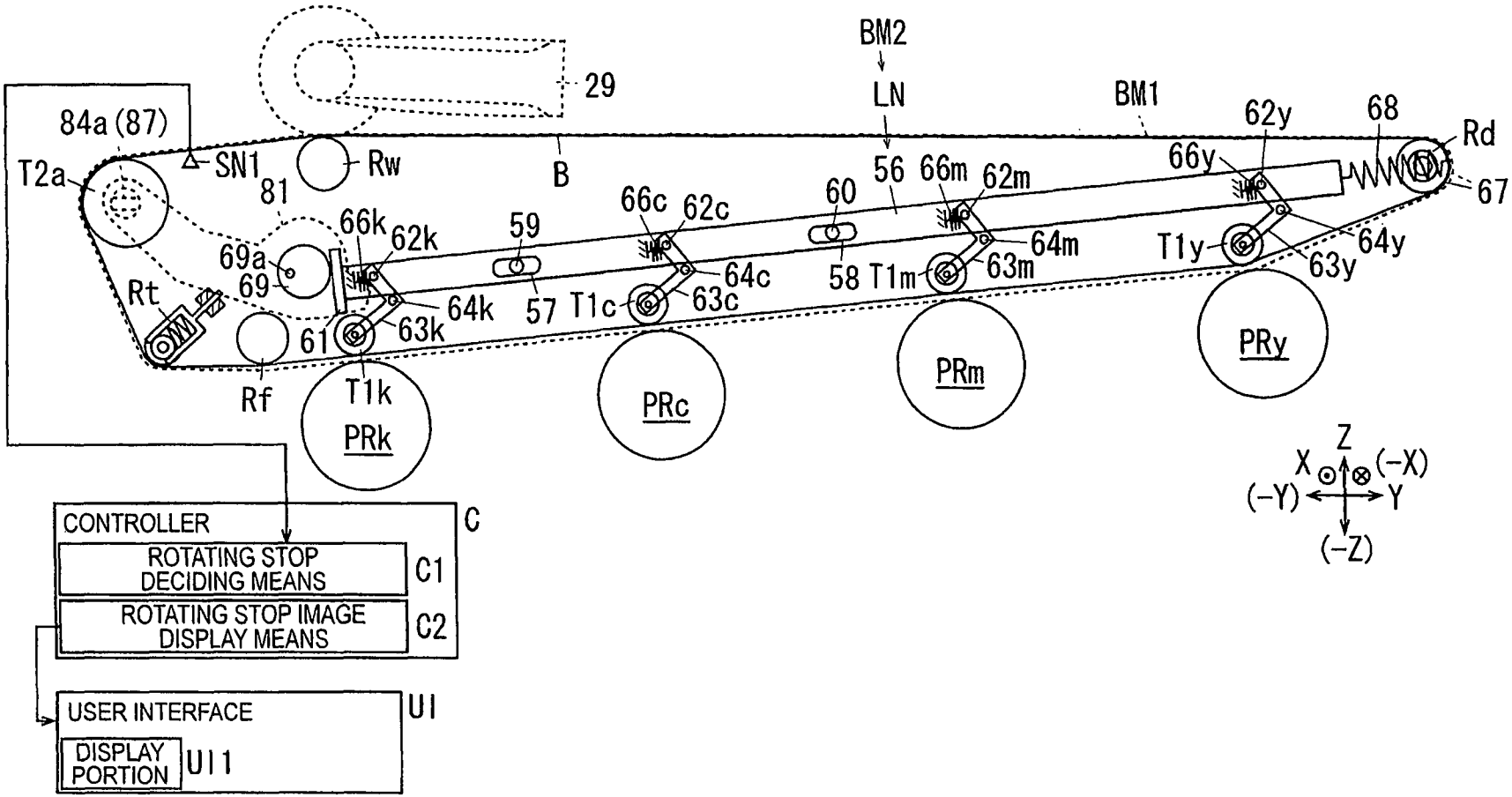
FIG. 17 is an explanatory view showing a rotation control of the intermediate transfer belt according to the first example, illustrating a state in which the coupling cover is attached to the rear coupling in the condition of FIG. 11B.

FIG. 17 is an explanatory view showing a rotation control of the intermediate transfer belt according to the first example and is an explanatory view showing a state in which the coupling cover is attached to the rear coupling in the condition of FIG. 11B.

Figure 18:
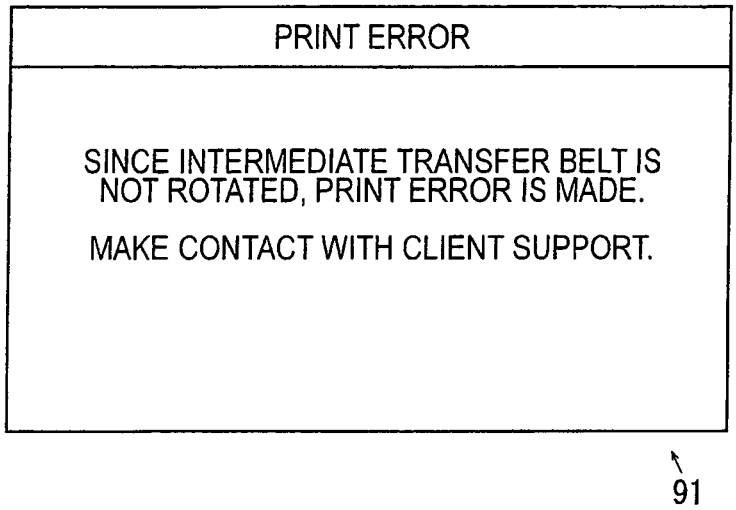
FIG. 18 is an explanatory view showing a rotation control image according to the first example.

FIG. 18 is an explanatory view showing a rotation controlling image according to the first example.

Moreover, the controller C according to the first example has rotating stop deciding means C1 and rotating stop image display means C2 shown in FIG. 17. The rotating stop deciding means C1 according to the first example decides whether the rotation of the intermediate transfer belt B is maintained to be stopped or not based on a detecting signal of a rotation detecting member SN1 in a driving operation of the belt driving roll Rd. More specifically, if the rotation detecting member SN1 does not detect a detected portion of the intermediate transfer belt B until a rotating time passes after the belt driving roll Rd is driven, it is decided that the rotation of the intermediate transfer belt B is maintained to be stopped. If it is decided that the rotation of the intermediate transfer belt B is maintained to be stopped by the rotating stop deciding means C1, furthermore, the rotation stop image display means C2 according to the first example displays, on a display portion UI1 of the user interface UI, a rotation controlling image 91 for giving a notice that the intermediate transfer belt B is not rotated as shown in FIG. 18.

(Function of First Example)

In the copying machine U according to the first example having the structure described above, in the case in which the opening/closing plate 6 is moved to the coupling enabling position shown in FIG. 4, the operator may rotate and move the handle 29 to the locking position shown in FIG. 6 and the unlocking position shown in FIG. 12.

When the handle 29 is moved between the locking position and the unlocking position, the positioning plate 47 is slid between the downward position shown in FIG. 6 and the upward position shown in FIG. 12 so that the operations for positioning the photosensitive members PRy to PRk and releasing the positioning are executed.

At this time, in the case in which the front coupling 41 is moved to the transmission enabling position shown in FIGS. 9 and 10 so that the couplings 41 and 71 are coupled to each other, the belt positioning mechanism BM2 is slid between a transfer pressing position shown in FIG. 11A and a transfer retreating position shown in FIG. 11B and the intermediate transfer belt B is moved between a contact position shown in FIG. 11A and a separating position shown in FIG. 11B interlockingly with the rotating movement of the handle 29.

In the copying machine U according to the first example, therefore, it is possible to position the photosensitive members PRy to PRk and the intermediate transfer belt B and to release the positioning at the same time depending on the operation of the handle 29.

In the case in which the couplings 41 and 71 are coupled to each other, accordingly, it is possible to bring a first arranging state in which the intermediate transfer belt B is moved to the contact position and the photosensitive members PRy to PRk are positioned and a second arranging state in which the intermediate transfer belt B is moved to the separating position and the positioning of the photosensitive members PRy to PRk is released.

In the copying machine U according to the first example having the structure described above, in the case in which the coupling cover 81 is attached to the rear coupling 71, the coupling click portions 44 and 44 of the front coupling 41 come in contact with the front surface of the coupling controlling portion 82 and are thus pressed when the opening/closing plate 6 is moved to the coupling enabling position. For this reason, the front coupling 41 is pressed forward against a rearward energizing force of the elastic spring 45 and is thus moved to the transmission releasing position on the inner side of the opening/closing plate 6 as shown in FIGS. 14 to 16.

In this case, even if the handle 29 is rotated and moved, the eccentric rotating shaft 69*a* is not rotated, the link LN is not moved and the intermediate transfer belt B is not interlocked.

In the copying machine U according to the first example, accordingly, it is also possible to position only the photosensitive members PRy to PRk and to release the positioning depending on the operation of the handle 29.

Accordingly, in the case in which the couplings 41 and 71 are decoupled from each other in a state in which the intermediate transfer belt B is moved to the separating position, for example, it is possible to carry out a movement into a third arranging state in which the intermediate transfer belt B is moved to the separating position and the photosensitive members PRy to PRk are positioned. Moreover, in the case in which the couplings 41 and 71 are decoupled from each other in a state in which the intermediate transfer belt B is moved to the contact position, for example, it is also possible to bring a fourth arranging state in which the intermediate transfer belt B is moved to the contact position and the positioning of the photosensitive members PRy to PRk is released.

As a result, in the copying machine U according to the first example, the members B and PRy to PRk to be positioned and released may be brought into four different arranging states depending on the operation of the handle 29.

As shown in FIG. 11, when the intermediate transfer belt B according to the first example is moved from the separating position to the contact position, a tension to be applied by each of the rolls Rd, Rt, Rw, Rf, T2*a*, and T1*y* to T1*k* is increased. For this reason, in the case in which the copying machine U is stored for a long period of time in a state in which the intermediate transfer belt B is moved to the contact position, for example, a winding curl is apt to occur in portions of the intermediate transfer belt B which are wound around the rolls Rd, Rt, Rw, Rf, T2*a*, and T1*y* to T1*k* more greatly than in the case in which the copying machine U is disposed in the separating position and is thus stored. In this case, when the intermediate transfer belt B having the winding curl is rotated, for example, a rotating speed is apt to be varied every time the portion having the winding curl approaches the rolls Rd, Rt, Rw, Rf, T2*a*, and T1*y* to T1*k* and there is a possibility that the rotation of the whole intermediate transfer belt B might be unstable. When the rotation of the intermediate transfer belt B is unstable, there is a possibility that an image failure might be caused by a defective transfer of a toner image.

In the case in which the copying machine U is stored, therefore, the intermediate transfer belt B may be disposed in the separating position.

With the structure in which the coupling is not carried out through the couplings 41 and 71, however, the photosensitive members PRy to PRk and the intermediate transfer belt B are positioned and the positioning is released at the same time depending on the operation of the handle 29, and the positioning of the photosensitive members PRy to PRk is also released when the positioning of the intermediate transfer belt B is released. In this case, when the copying machine U is transported, for example, there is a possibility that the intermediate transfer belt B and the photosensitive members PRy to PRk themselves might be damaged or broken due to a motion of the photosensitive members PRy to PRk.

On the other hand, in the copying machine U according to the first example, the couplings 41 and 71 are decoupled from each other when the coupling cover 81 is attached. Therefore, it is possible to bring the third arranging state in which the photosensitive members PRy to PRk are positioned and the positioning of the intermediate transfer belt B is released. When the coupling cover 81 is removed, the couplings 41 and 71 are coupled to each other. Consequently, it is also possible to bring the first arranging state in which the respective members PRy to PRk and B are positioned at the same time or the second arranging state in which the positioning of the members PRy to PRk and B is released at the same time.

As a result, in the copying machine U according to the first example, it is possible to reduce the occurrence of the winding curl in a storage or the damage of the members PRy to PRk and B during a transportation more greatly by bringing the third arranging state in the storage or transportation as compared with the structure in which the coupling is not carried out through the couplings 41 and 71.

It is necessary to bring a state in which the intermediate transfer belt B is laid with a tension in order to cause the copying machine U to enable an image formation when the copying machine U is to be transported and provided in a condition in which the photosensitive members PRy to PRk are positioned and the intermediate transfer belt B has a small tension.

In this case, in the copying machine U according to the first example, the handle 29 is first rotated and moved to the unlocking position and the opening/closing plate 6 is then rotated forward and moved to the decoupling position so that the coupling cover 81 is removed through the opening 1*a* of the frame member 1. In this state, the positioning of both the photosensitive members PRy to PRk and the intermediate transfer belt B is released. When the opening/closing plate 6 is rotated and moved to the coupling enabling position, thereafter, the couplings 41 and 71 are coupled to each other. When the handle 29 is rotated and moved to the locking position in the state in which the couplings 41 and 71 are coupled to each other, the positioning of each of the members PRy to PRk and B is executed. As a result, in the copying machine U according to the first example, switching from the second arranging state to the first arranging state is executed so that an image forming operation may be carried out.

When the copying machine U is to be provided, moreover, the coupling cover 81 might be forgotten to be removed. In the first example, in the state in which the coupling cover 81 is attached, the fitted portion 87 of the backup roll T2*a* is fitted in the fitting slot 84*a* of the coupling cover 81 and the rotation of the backup roll T2*a* is thus controlled. Furthermore, the tension of the intermediate transfer belt B is also reduced and the belt driving roll Rd and the intermediate transfer belt B slip so that the rotation of the belt driving roll Rd is transmitted to the intermediate transfer belt B with difficulty. For this reason, even if the belt driving roll Rd is driven, the image forming operation may not be executed with the rotation of the intermediate transfer belt B maintained to be stopped.

In the copying machine U according to the first example, it is decided that the rotation of the intermediate transfer belt B is maintained to be stopped through the detecting signal of the rotation detecting member SN1 shown in FIG. 17 and the rotation controlling image 91 shown in FIG. 18 is displayed on the display portion UI1.

Accordingly, the operator may recognize that the rotation of the intermediate transfer belt B is maintained to be stopped and may confirm whether the coupling cover 81 is removed or not. As a result, in the first example, it is possible to reduce the use of the copying machine U in a state in which the coupling cover 81 is forgotten to be removed.

SECOND EXAMPLE

Next, a second example according to the invention will be described. In the explanation of the second example, components corresponding to the components in the first example have the same reference numerals and detailed description thereof will be omitted.

Although the second example is different from the first example in the following respects, it has the same structure as that in the first example in the other respects.

Figures 19A, 19B, 19C, 19D:
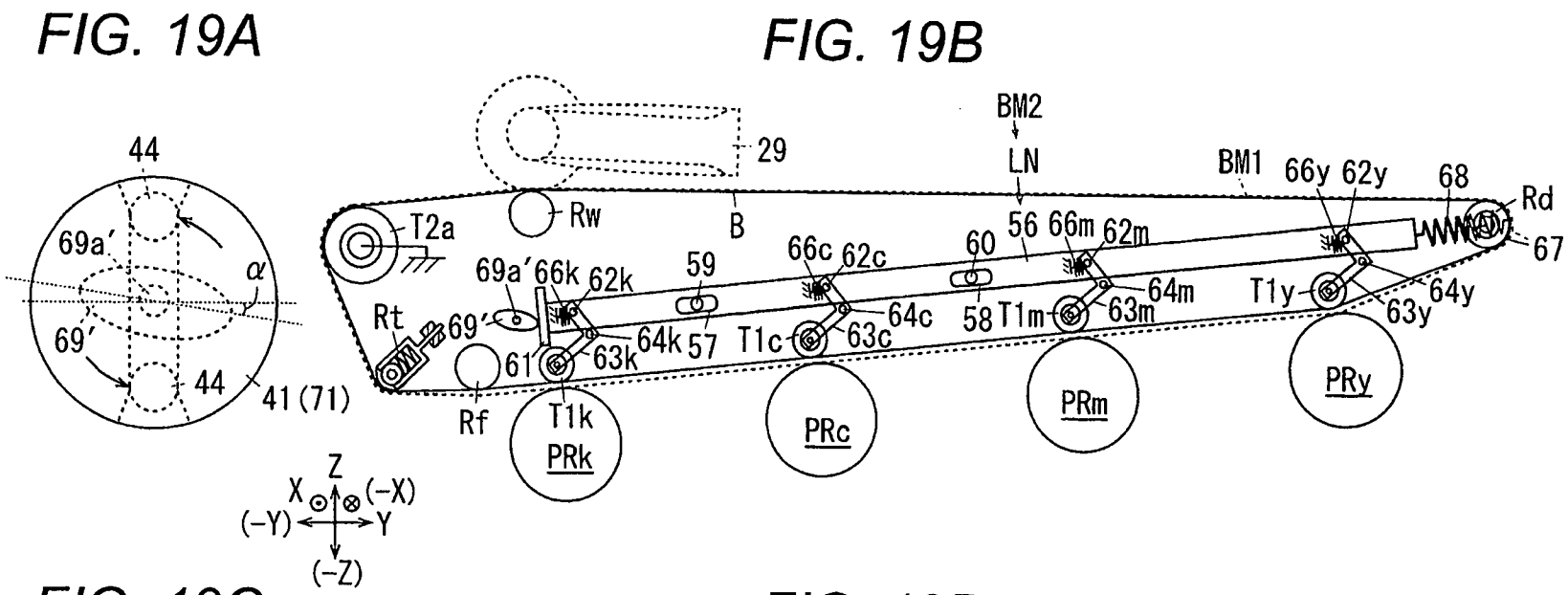
FIG. 19 is an explanatory view showing a coupling and an elliptical cam according to a second example, FIG. 19A being an explanatory view showing the coupling and an eccentric cam in a state in which the couplings are coupled to each other to rotate a handle to an unlocking position, FIG. 19B being an explanatory view showing a state in which an intermediate transfer belt is moved to a separating position in the condition of FIG. 19A, FIG. 19C being an explanatory view showing the coupling and the eccentric cam in a state in which only a rear coupling is rotated from an engaging position to an engaging controlling position to carry out decoupling in the condition of FIG. 19A, and FIG. 19D being an explanatory view showing a state in which the intermediate transfer belt is moved to the separating position in the condition of FIG. 19C.

FIG. 19 is an explanatory view showing a coupling and an elliptical cam according to the second example, and FIG. 19A is an explanatory view showing the coupling and an eccentric cam in a state in which the couplings are coupled to each other to rotate a handle to an unlocking position, FIG. 19B is an explanatory view showing a state in which an intermediate transfer belt is moved to a separating position in the condition of FIG. 19A, FIG. 19C is an explanatory view showing the coupling and the eccentric cam in a state in which only a rear coupling is rotated from an engaging position to an engaging controlling position to carry out decoupling in the condition of FIG. 19A, and FIG. 19D is an explanatory view showing a state in which the intermediate transfer belt is moved to the separating position in the condition of FIG. 19C.

In a copying machine U according to the second example, the coupling cover 81 according to the first example is omitted. In the copying machine U according to the second example, moreover, an elliptical cam 69' according to an example of an elliptical rotating member which has an elliptical section and takes a shape of a plate as shown in FIG. 19 is provided in place of the eccentric cam 69 according to the first example.

While the eccentric cam 69 is disposed in such a manner that the eccentric direction of the eccentric cam 69 is orthogonal to the extending direction of the coupling engaging groove 72*b* in the first example, the elliptical cam 69' is supported on an elliptical rotating shaft 69*a*' in such a manner that a direction of a long side of the elliptical section of the elliptical cam 69' crosses an extending direction of a coupling engaging groove 72*b* with a tilt at a preset tilt angle a from an orthogonal state in the second example.

(Explanation of Decoupling of Coupling 41, 71 According to Second Example)

In FIG. 19A, moreover, in the case in which a handle 29 is rotated to an unlocking position to move a belt positioning mechanism BM2 to a transfer retreating position in the second example, couplings 41 and 71 are set into a state in which the coupling engaging groove 72*b* is extended in a vertical direction in the same manner as in the first example. For this reason, the elliptical cam 69' is brought into an engaging state with a cam engaging portion 61 in a right, oblique and lower position with respect to the elliptical rotating shaft 69*a*' as shown in FIG. 19B. In other words, the elliptical cam 69' according to the second example is brought into the engaging state with the cam engaging portion 61 in a first tilt pressing position which is rotated in a clockwise direction of FIG. 19A by the tilt angle $\alpha$ from the pressing position shown in FIG. 11B of the eccentric cam 69 according to the first example.

In the second example, moreover, it is possible to open an opening/closing plate 6, thereby decoupling the couplings 41 and 71 from each other in the state of FIG. 19B, and to then rotate the rear coupling 71 in a further counterclockwise direction Ya. In the case in which the rear coupling 71 is rotated by an angle $2\alpha$, the elliptical cam 69' is brought into an engaging state with the cam engaging portion 61 in the same position as that of FIG. 19B in a right, oblique and upper position with respect to the elliptical rotating shaft 69*a*' as shown in FIG. 19D. In other words, the elliptical cam 69' according to the second example is brought into an engaging state with the cam engaging portion 61 in a second tilt pressing position which is rotated in the counterclockwise direction of FIG. 19C by the tilt angle a from the pressing position of the eccentric cam 69 according to the first example.

Even if the opening/closing plate 6 is closed in the state of FIG. 19D, furthermore, coupling click portions 44 and 44 are not fitted in the coupling engaging groove 72*b* so that the couplings 41 and 71 are decoupled from each other as shown in FIG. 19C.

Accordingly, the rear coupling 71 according to the second example is rotatable between an engaging position in which the coupling click portions 44 and 44 are engaged with the coupling engaging groove 72*b* and an engaging controlling position in which a phase is shifted from the engaging position so that the engagement of the coupling engaging groove 72*b* and the coupling click portions 44 and 44 is controlled.

In the second example, a distance La between the elliptical rotating shaft 69*a*' and the cam engaging portion 61 shown in FIGS. 19B and 19D is preset to be equal to a distance between an eccentric rotating shaft 69*a* and the cam engaging portion 61 according to the first example.

(Explanation of Coupling Return of Coupling 41, 71 According to Second Example)

When the opening/closing plate 6 is opened and the rear coupling 71 is then rotated by the angle 2α in the clockwise direction in the state of FIG. 19D, moreover, the elliptical cam 69' is returned to the state of FIG. 19B. For this reason, in the case in which the opening/closing plate 6 is closed, the coupling click portions 44 and 44 are fitted in the coupling engaging groove 72*b* so that the couplings 41 and 71 may be coupled to each other again as shown in FIG. 19A.

As a result, the phase is shifted through the rotation of the rear coupling 71 so that the front coupling 41 according to the second example may be moved between a transmission enabling position shown in FIG. 19A and a transmission releasing position shown in FIG. 19C.

(Function of Second Example)

In the copying machine U according to the second example having the structure described above, when the handle 29 is moved to the unlocking position and the belt positioning mechanism BM2 is slid to the transfer retreating position, an intermediate transfer belt B is moved to the separating position shown in FIG. 19B.

In this state, when the opening/closing plate 6 is opened and moved to a coupling controlling position and the rear coupling 71 is rotated by the angle 2α in the counterclockwise direction Ya, the intermediate transfer belt B is held to be moved to the separating position as shown in FIG. 19D.

At this time, in the second example, the rear coupling 71 is rotated from the engaging position shown in FIG. 19A to the engaging controlling position shown in FIG. 19C. For this reason, when the opening/closing plate 6 is closed and moved to a coupling enabling position, the coupling click portions 44 and 44 of the front coupling 41 come in contact with a front surface of a rear coupling body 72 and are thus pressed. As a result, the front coupling 41 is pressed forward against a rearward energizing force of an elastic spring 45 and is moved to the transmission releasing position on an inner side of the opening/closing plate 6.

In this case, even if the handle 29 is rotated and moved, the coupling click portions 44 and 44 slip over the front surface of the rear coupling body 72, the eccentric rotating shaft 69*a* is not rotated and a link LN is not moved. Accordingly, the intermediate transfer belt B is not interlocked but only photosensitive members PRy to PRk are positioned and the positioning is released.

In the copying machine U according to the second example, therefore, it is possible to carry out a movement into a third arranging state in which the intermediate transfer belt B is moved to the separating position and the photosensitive members PRy to PRk are positioned in the same manner as in the first example. As a result, in the copying machine U according to the second example, it is possible to reduce an occurrence of a winding curl during a storage or a damage of each of the members PRy to PRk and B during a transportation by setting the third arranging state in the storage or transportation in the same manner as in the first example.

In addition, the copying machine U according to the second example produces the same functions and effects as those of the copying machine U according to the first example.

THIRD EXAMPLE

Next, a third example according to the invention will be described. In the explanation of the third example, components corresponding to the components in the first example have the same reference numerals and detailed description thereof will be omitted.

Although the third example is different from the first example in the following respects, it has the same structure as that in the first example in the other respects.

(Explanation of Lower Coupling Gear 31 According to Third Example)

Figure 20C:
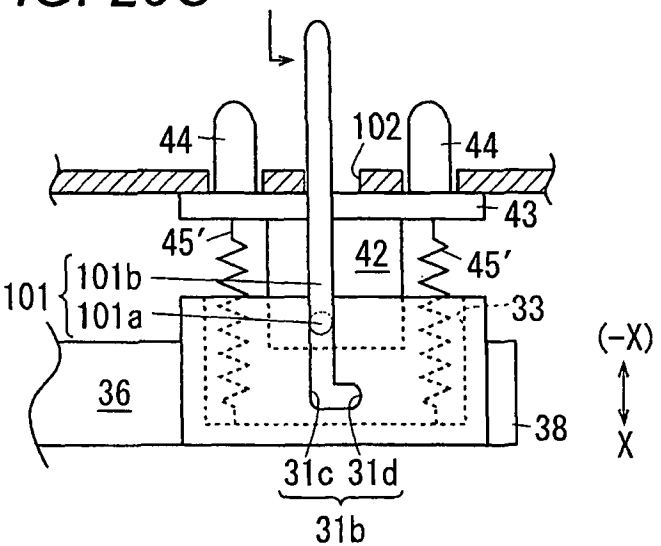
FIG. 20 is an explanatory view showing a lower coupling gear according to a third example, FIG. 20A being a perspective enlarged explanatory view showing the lower coupling gear, FIG. 20B being a sectional view taken along an XXB-XXB line in FIG. 20A, FIG. 20C being an explanatory view showing a state in which the lower coupling gear is seen in a direction of an arrow XXC in FIG. 20A, and FIG. 20D being an explanatory view showing a state in which a lever is moved forward in the condition of FIG. 20C.
Figure 20D:
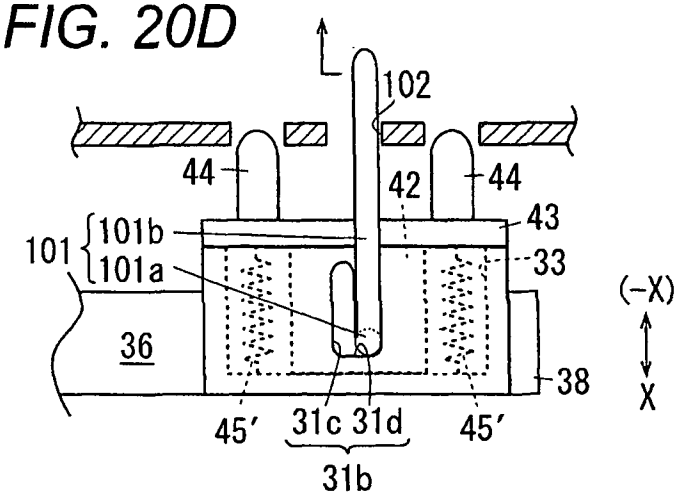
Figure 20A:
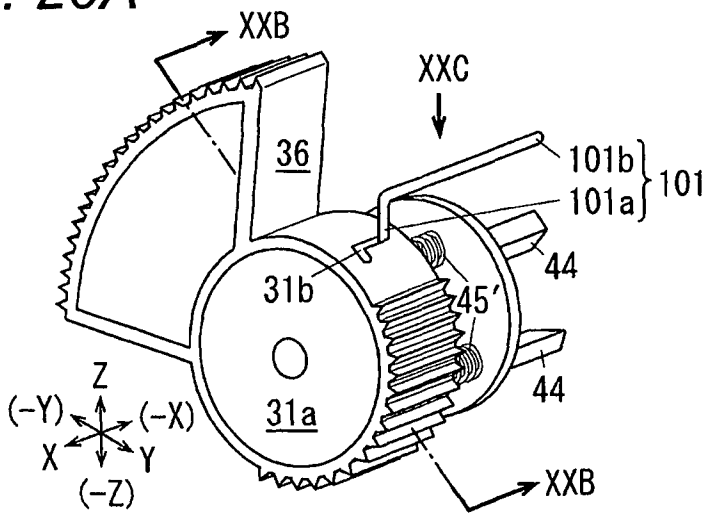
Figure 20B:
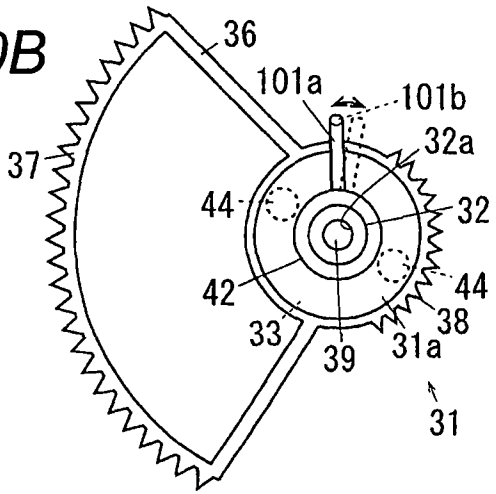

FIG. 20 is an explanatory view showing a lower coupling gear according to the third example, and FIG. 20A is a perspective enlarged explanatory view showing the lower coupling gear, FIG. 20B is a sectional view taken along an XXB-XXB line in FIG. 20A, FIG. 20C is an explanatory view showing a state in which the lower coupling gear is seen in a direction of an arrow XXC in FIG. 20A, and FIG. 20D is an explanatory view showing a state in which a lever is moved forward in the condition of FIG. 20C.

In FIG. 20, an operation guiding hole 31*b* is formed between a fan plate 36 and a lower gear portion 38 over an outer peripheral surface of a gear body 31*a* of a lower coupling gear 31 according to the third example. The operation guiding hole 31*b* according to the third example has a longitudinal guiding portion 31*c* extended in a longitudinal direction and a front end holding portion 31*d* extended in a clockwise direction from a front end of the longitudinal guiding portion 31*c*.

(Explanation of Operating Lever 101 According to Third Example)

Moreover, an operating lever 101 according to an example of a second operating portion is supported on a front end of an outer peripheral surface of a front coupling body 42 according to the third example.

The operating lever 101 according to the third example is provided with a guiding groove penetrating portion 101*a* extended outward in a radial direction of the outer peripheral surface and a plate penetrating portion 101*b* according to an example of an opening/closing member penetrating portion extended rearward from an outer end in the radial direction of the guiding groove penetrating portion 101*a*.

In the third example, as shown in FIG. 20, the guiding groove penetrating portion 101*a* penetrates the operation guiding hole 31*b* and the plate penetrating portion 101*b* penetrates an operating through hole 102 of a rear wall member 8.

The operating through hole 102 according to the third example is formed to take a shape of a semicircular arc on an outside of coupling through holes 8*k* and 8*k* depending on a moving range of the plate penetrating portion 101*b* through a rotation of the lower coupling gear 31.

(Explanation of Elastic Spring 45', 45' According to Third Example)

Moreover, plural of elastic springs 45' and 45' is supported in a spring housing portion 33 according to the third example in place of the elastic spring 45 according to the first example. The elastic springs 45' and 45' according to the third example are disposed to keep away from the front coupling body 42 and the guiding groove penetrating portion 101*a* of the operating lever 101. More specifically, they are disposed in forward opposed positions to coupling click portions 44 and 44 with a flange portion 43 interposed therebetween.

(Explanation of Decoupling of Coupling 41, 71 According to Third Example)

In FIGS. 20A to 20C, in the third example, in the case in which a handle 29 is rotated to an unlocking position to move a belt positioning mechanism BM2 to a transfer retreating position, the plate penetrating portion 101*b* of the operating lever 101 is exposed when an opening/closing plate 6 is opened. At this time, when the plate penetrating portion 101*b* is pressed toward the forward rear wall member 8 side, a front coupling 41 is pressed forward against a rearward energizing force of the elastic springs 45' and 45' and is moved to an inner side of the opening/closing plate 6. At this time, the guiding groove penetrating portion 101*a* of the housing lever 101 is guided to the longitudinal guiding portion 31*c* and is moved to the front end of the longitudinal guiding portion 31*c*.

When the plate penetrating portion 101*b* is rotated and moved in a clockwise direction seen from a forward part, that is, a counterclockwise direction seen from the rear wall member 8 side in this state, the guiding groove penetrating portion 101*a* is guided to the front end holding portion 31*d* to bring the state of FIG. 20D in which the front coupling 41 is held on the inner side of the opening/closing plate 6.

Even if the opening/closing plate 6 is closed in the state of FIG. 20D, accordingly, the coupling click portions 44 and 44 are not fitted in a coupling engaging groove 72*b* but the couplings 41 and 71 are set into a decoupling state.

(Explanation of Coupling Return of Coupling 41, 71 According to Third Example)

When the plate penetrating portion 101*b* is rotated and moved in the counterclockwise direction seen from the forward part, that is, the clockwise direction seen from the rear wall member 8 side in the state of FIG. 20D, furthermore, the guiding groove penetrating portion 101*a* is guided to the front end of the longitudinal guiding portion 31*c*. In this state, when an operator releases the plate penetrating portion 101*b*, the front coupling 41 is pressed rearward and returned into the state of FIG. 20B by the rearward energizing force of the elastic springs 45' and 45'. For this reason, in the case in which the opening/closing plate 6 is closed, the coupling click portions 44 and 44 are fitted in the coupling engaging groove 72*b* so that the couplings 41 and 71 may be coupled to each other again.

As a result, the front coupling 41 according to the third example may be moved between a transmission enabling position shown in FIG. 20C and a transmission releasing position shown in FIG. 20D through an operation of the operating lever 101.

(Function of Third Example)

In a copying machine U according to the third example having the structure described above, when the handle 29 is moved to the unlocking position to slide the belt positioning mechanism BM2 to the transfer retreating position, an intermediate transfer belt B is moved to a separating position.

In this state, when the opening/closing plate 6 is opened and moved to a coupling enabling position and the exposed operating lever 101 is then operated, the front coupling 41 is held on the inner side of the opening/closing plate 6 as shown in FIG. 20D. For this reason, even if the opening/closing plate 6 is closed and moved to a coupling controlling position, the front coupling 41 is maintained to be held in the transmission releasing position which is moved to the inner side of the opening/closing plate 6. In this case, even if the handle 29 is rotated and moved, an eccentric rotating shaft 69*a* is not rotated and a link LN is not moved. Accordingly, the intermediate transfer belt B is not interlocked but only photosensitive members PRy to PRk are positioned and the positioning is released.

In the copying machine U according to the third example, therefore, it is possible to carry out a movement into a third arranging state in which the intermediate transfer belt B is moved to the separating position and the photosensitive members PRy to PRk are positioned in the same manner as in the first and second examples. As a result, in the copying machine U according to the third example, it is possible to reduce an occurrence of a winding curl during a storage or a damage of each of the members PRy to PRk and B during a transportation by setting the third arranging state in the storage or transportation in the same manner as in the first and second examples.

In addition, the copying machine U according to the third example produces the same functions and effects as those of the copying machine U according to the first and second examples.

(Variant)

Although the examples according to the invention have been described above in detail, the invention is not restricted to the examples but various changes may be made without departing from the gist of the invention described in the claims. Variants (H01) to (H08) according to the invention will be described below.

(H01) Although the copying machine U has been taken as an example of the image forming apparatus in the examples, the invention is not restricted thereto but it is also possible to employ a compound machine including a FAX and plural of functions, for instance. Moreover, the invention is not restricted to a color image forming apparatus but may also be applied to a monochromatic image forming apparatus.

(H02) Although the positioned member to be positioned and released through the rotation of the handle 29 is set to be the intermediate transfer belt B and the photosensitive members PRy to PRk in the examples, the positioned member is not restricted thereto but may also be set to be the other members, for instance, the latent image forming devices LHy to LHk or the developing devices Gy to Gk.

(H03) In the examples, the coupling of the couplings 41 and 71 is not restricted to the shapes of the coupling click portions 44 and 44 and the coupling engaging groove 72*b* but may be carried out through engaging and engaged portions taking optional shapes.

(H04) Although the operator rotates the rear coupling 71 to the engaging controlling position or operates the operating lever 101 manually to disengage the coupling click portions 44 and 44 from the coupling engaging groove 72*b* in the second and third examples, the invention is not restricted thereto but the operator may also disengage the coupling click portions 44 and 44 from the coupling engaging groove 72*b* by rotating the rear coupling 71 to the engaging controlling position or operating the operating lever 101 by means of a tool or a jig, for instance.

(H05) Although the plate penetrating portion 101*b* of the operating lever 101 is extended rearward to cause the rear wall member 8 to penetrate therethrough in the third example, the invention is not restricted thereto but the plate penetrating portion 101*b* may also be extended forward to cause the front wall member 7 to penetrate therethrough. In this case, an operator may operate the operating lever 101 to disengage the coupling click portions 44 and 44 from the coupling engaging groove 72*b*, thereby decoupling the couplings 41 and 71 from each other with the opening/closing plate 6 closed. In this case, when the handle 29 is rotated, there is a possibility that the gripping portion 29*b* and the plate penetrating portion 101*b* might come in contact with each other to control the rotation. For this reason, it is necessary to dispose the gripping portion 29*b* and the plate penetrating portion 101*b* while keeping away from a rotating track of the gripping portion 29*b*.

(H06) Although the elliptical cam 69' shown in FIG. 19 is moved among the standby position (not shown) corresponding to the locking position of the handle 29, the first tilt pressing position corresponding to the unlocking position of the handle 29 and the second tilt pressing position corresponding to the engaging controlling position of the rear coupling 71 in the second example, the shape of the cam is not restricted thereto but the eccentric cam 69 shown in FIG. 11 may also be moved among the standby position, the first tilt pressing position and the second tilt pressing position, for instance.

(H07) Although the elliptical cam 69 is moved to the first tilt pressing position and the intermediate transfer belt B is moved to the separating position when the handle 29 is moved to the unlocking position in the second example, the invention is not restricted thereto but it is also possible to employ a structure in which the elliptical cam 69' is moved to the pressing position and the intermediate transfer belt B is thus moved to the separating position when the handle 29 is moved to the unlocking position, for instance. In this case, when the rear coupling 71 is rotated to the engaging controlling position in the state in which the intermediate transfer belt B is moved to the separating position, the intermediate transfer belt B is moved from the separating position to the second separating position in which the tension to be applied to the intermediate transfer belt B is increased. Even if the intermediate transfer belt B is moved to the second separating position, however, it is possible to reduce an occurrence of a winding curl during a storage or a damage of each of the members PRy to PRk and B during a transportation in the intermediate transfer belt B when the tension for stretching the intermediate transfer belt B is sufficiently small and the intermediate transfer belt B is caused to separate from the photosensitive members PRy to PRk which are positioned. In other words, the invention is not restricted to the structure in which the intermediate transfer belt B according to the second example is held in the separating position when the phases of the coupling click portions 44 and 44 and the coupling engaging groove 72*b* are shifted to prevent them from being engaged with each other even if the opening/closing plate 6 is closed but it is also possible to employ a structure in which the intermediate transfer belt B is held in the second separating position moved slightly from the separating position.

(H08) Although the rear coupling 71 is rotated to disengage the coupling click portions 44 and 44 from the coupling engaging groove 72*b* in the second example, the invention is not restricted thereto but the front coupling 41 may also be rotated to disengage the coupling click portions 44 and 44 from the coupling engaging groove 72*b*. For instance, it is possible to move the intermediate transfer belt B to the separating position through the rotation of the handle 29 to the unlocking position, to then open the opening/closing plate 6 and to slightly rotate the handle 29 to the locking position side in the clockwise direction, thereby rotating the front coupling 41 to shift the phases of the coupling click portions 44 and 44 and the coupling engaging groove 72*b*, resulting in a disengagement even if the opening/closing plate 6 is closed. In this case, when the opening/closing plate 6 is closed, the coupling click portions 44 and 44 come in contact with the front surface of the rear coupling body 72 so that the front coupling 41 is moved to the transmission releasing position on the inner side of the opening/closing plate 6. When the handle 29 is perfectly rotated to the locking position, the coupling click portions 44 and 44 slip over the front surface of the rear coupling body 72, the eccentric rotating shaft 69*a* is not rotated and the intermediate transfer belt B is not interlocked. In this state, it is possible to carry out the movement into the third arranging state in which the intermediate transfer belt B is moved to the separating position and the photosensitive members PRy to PRk are positioned in the same manner as in the structure according to the second example. In this case, when the handle 29 is rotated to the unlocking position, the positioning of the photosensitive members PRy to PRk is released and the coupling click portions 44 and 44 are fitted in the coupling engaging groove 72*b* in a stage in which the handle 29 is perfectly rotated to the unlocking position so that the intermediate transfer belt B may be interlocked with the operation of the handle 29. In this case, it is necessary to make such a design that the controlled portions 28 and 54 of the upper lock gear 23 and the positioning plate 47 are not controlled by the controlled portions 2*c* and 3*a* of the upper lock 2 and the right lock 3 but the opening/closing plate 6 may be closed also in a state in which the handle 29 is slightly rotated to the locking position side.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a first positioned member;

a first positioning member that moves between a first positioning position in which the first positioned member is positioned and a first releasing position in which the positioning of the first positioned member is released;

a first transmitted member supported on the first positioning member;

a second positioned member;

a second positioning member that moves between a second positioning position in which the second positioned member is positioned and a second releasing position in which the positioning of the second positioned member is released;

a second transmitted member supported on the second positioning member;

an operating portion, formed by a single member that is operated by an operator;

a first transmitting member supported on the operating portion, coupled removably to the first transmitted member and transmitting an operation of the operating portion to the first transmitted member;

a second transmitting member supported on the operating portion and transmitting the operation of the operating portion to the second transmitted member; and the operating portion that moves between a first operating position in which each of the positioning members is moved to each of the positioning positions and a second operating position in which each of the positioning members is moved to each of the releasing positions through each of the transmitting members and each of the transmitted members when the first transmitting member and the first transmitted member are coupled to each other, and that carries out the movement to the first operating position to move the second positioning member to the second positioning position through the second transmitting member and the second transmitted member and carries out the movement to the second operating position to move the second positioning member to the second releasing position when the first transmitting member and the first transmitted member are decoupled from each other.

2. The image forming apparatus according to claim 1 further comprising:

an operation enabling member that supports the operating portion and moves between a coupling enabling position in which the first transmitting member and the first transmitted member is coupled to each other and a decoupling position in which the first transmitting member and the first transmitted member are decoupled from each other.

3. The image forming apparatus according to claim 2 further comprising:

the first transmitting member that moves between a transmission enabling position in which the operation of the operating portion is transmitted in contact with the first transmitted member and a transmission releasing position in which the transmission of the operation of the operating portion is released apart from the first transmitted member toward the operation enabling member side in a state in which the operation enabling member is moved to the coupling enabling position; and an energizing member for energizing the first transmitting member to the transmission enabling position.

4. The image forming apparatus according to claim 2 further comprising:

a coupling controlling member that is removably attached to either the first transmitted member or the first transmitting member and controls the coupling of the first transmitted member and the first transmitting member;

wherein the operation enabling member is moved to the coupling enabling position in a state in which the coupling of the first transmitted member and the first transmitting member is controlled by the coupling controlling member.

5. The image forming apparatus according to claim 2 further comprising:

the first transmitting member that has an engaging portion and is rotatable by setting, as a rotating center, a coupling direction for connecting the first transmitted member and the operation enabling member;

the first transmitted member that has an engaged portion with which the engaging portion is engaged and is rotatable with the coupling direction set to be the rotating center, and is disposed relatively with the first transmitting member between an engaging position in which the engaging portion and the engaged portion are engaged with each other and an engaging controlling position in which a phase is shifted from the engaging position so that the engagement of the engaging portion and the engaged portion is controlled; and the operation enabling member that is moved to the coupling enabling position in a state in which the first transmitted member is moved to the engaging controlling position to control the engagement of the engaging portion and the engaged portion.

6. The image forming apparatus according to claim 2 further comprising:

a second operating portion that is supported on the operation enabling member, and moves the first transmitting member between the transmission enabling position in which the operation of the second operating portion is transmitted in contact with the first transmitted member and the transmission releasing position in which the transmission of the operation of the second operating portion is released apart from the first transmitted member toward the operation enabling member side.

7. An image forming apparatus comprising:

an image holding member for holding an image;

an intermediate transfer member disposed with an outer surface opposed to the image holding member;

a positioning member for the intermediate transfer member that moves between a first positioning position in which the intermediate transfer member is positioned and a first releasing position in which the positioning of the intermediate transfer member is released;

a first transmitted member supported on the positioning member for the intermediate transfer member;

a positioning member for the image holding member that moves between a second positioning position in which the image holding member is positioned and a second releasing position in which the positioning of the image holding member is released;

a second transmitted member supported on the positioning member for the image holding member;

an operating portion, formed by a single member that is operated by an operator;

a first transmitting member that is supported on the operating portion, is removably coupled to the first transmitted member and transmits an operation of the operating portion to the first transmitted member;

a second transmitting member that is supported on the operating portion and serves to transmit the operation of the operating portion to the second transmitted member; and the operating portion that moves between a first operating position in which each of the positioning members is moved to each of the positioning positions and a second operating position in which each of the positioning members is moved to each of the releasing positions through each of the transmitting members and each of the transmitted members when the first transmitting member and the first transmitted member are coupled to each other, and that carries out the movement to the first operating position to move the positioning member for the intermediate transfer member to the second positioning position through the second transmitting member and the second transmitted member and carries out the movement to the second operating position to move the positioning member for the intermediate transfer member to the second releasing position when the first transmitting member and the first transmitted member are decoupled from each other.

8. The image forming apparatus according to claim 7 further comprising:

an operation enabling member that supports the operating portion and moves between a coupling enabling position in which the first transmitting member and the first transmitted member is coupled to each other and a decoupling position in which the first transmitting member and the first transmitted member are decoupled from each other.

9. The image forming apparatus according to claim 8 further comprising:

the first transmitting member that moves between a transmission enabling position in which the operation of the operating portion is transmitted in contact with the first transmitted member and a transmission releasing position in which the transmission of the operation of the operating portion is released apart from the first transmitted member toward the operation enabling member side in a state in which the operation enabling member is moved to the coupling enabling position; and an energizing member for energizing the first transmitting member to the transmission enabling position.

10. The image forming apparatus according to claim 8 further comprising:

a coupling controlling member that is removably attached to either the first transmitted member or the first transmitting member and controls the coupling of the first transmitted member and the first transmitting member;

wherein the operation enabling member is moved to the coupling enabling position in a state in which the coupling of the first transmitted member and the first transmitting member is controlled by the coupling controlling member.

11. The image forming apparatus according to claim 8 further comprising:

the first transmitting member that has an engaging portion and is rotatable by setting, as a rotating center, a coupling direction for connecting the first transmitted member and the operation enabling member;

the first transmitted member that has an engaged portion with which the engaging portion is engaged and is rotatable with the coupling direction set to be the rotating center, and is disposed relatively with the first transmitting member between an engaging position in which the engaging portion and the engaged portion are engaged with each other and an engaging controlling position in which a phase is shifted from the engaging position so that the engagement of the engaging portion and the engaged portion is controlled; and the operation enabling member that is moved to the coupling enabling position in a state in which the first transmitted member is moved to the engaging controlling position to control the engagement of the engaging portion and the engaged portion.

12. The image forming apparatus according to claim 8 further comprising:

a second operating portion that is supported on the operation enabling member, and moves the first transmitting member between the transmission enabling position in which the operation of the second operating portion is transmitted in contact with the first transmitted member and the transmission releasing position in which the transmission of the operation of the second operating portion is released apart from the first transmitted member toward the operation enabling member side.

13. The image forming apparatus according to claim 1, further comprising wherein the first positioned member is at least one of an imaging forming member or a photosensitive member;

wherein the second positioned member is an intermediate transfer member.

* * * * *